US012035815B2

(12) United States Patent
Fillingham et al.

(10) Patent No.: US 12,035,815 B2
(45) Date of Patent: Jul. 16, 2024

(54) COMPACT FURNITURE

(71) Applicant: The Coleman Company, Inc., Wichita, KS (US)

(72) Inventors: Erin Fillingham, Wichita, KS (US); Isaiah Gross, Haven, KS (US); Matthew G. Law, Huron, OH (US); Robert Lawhon, Andover, KS (US)

(73) Assignee: The Coleman Company, Inc., Wichita, KS (US)

( * ) Notice: Subject to any disclaimer, the term of this patent is extended or adjusted under 35 U.S.C. 154(b) by 173 days.

(21) Appl. No.: 17/762,440

(22) PCT Filed: Oct. 2, 2020

(86) PCT No.: PCT/US2020/054024
§ 371 (c)(1),
(2) Date: Mar. 22, 2022

(87) PCT Pub. No.: WO2021/067766
PCT Pub. Date: Apr. 8, 2021

(65) Prior Publication Data

US 2022/0400866 A1 Dec. 22, 2022

Related U.S. Application Data

(60) Provisional application No. 62/911,482, filed on Oct. 7, 2019, provisional application No. 62/910,805, filed on Oct. 4, 2019.

(51) Int. Cl.
*A47C 4/28* (2006.01)
*A47B 3/083* (2006.01)
(Continued)

(52) U.S. Cl.
CPC ..... *A47C 4/28* (2013.01); *A47B 3/083* (2013.01); *A47C 3/02* (2013.01); *A47C 17/72* (2013.01)

(58) Field of Classification Search
CPC .. A47C 4/28; A47C 3/02; A47C 17/72; A47C 3/12; A47C 4/286; A47C 7/624;
(Continued)

(56) References Cited

U.S. PATENT DOCUMENTS 1,856,429 A * 5/1932 Rodriguez ..... A47C 4/40 297/18
4,258,951 A * 3/1981 Groom ..... A47C 4/286 297/16.2

(Continued)

FOREIGN PATENT DOCUMENTS

CN 203435982 U 2/2014
CN 207979358 U 10/2018

*Primary Examiner* — Bradley Duckworth
(74) *Attorney, Agent, or Firm* — Husch Blackwell LLP

(57) ABSTRACT

Furniture such as a cot, table, or chair is provided that uses shock-corded poles in combination with one or many torsion spring mechanisms to achieve a compact pack size. Alternatively, central hubs may be used in lieu of the spring mechanisms. The furniture maintains its usefulness by assembling to a size comparable with conventional full-sized furniture. One or many torsion springs associated with the furniture allow a user to easily achieve tension over desired elements of the furniture while reducing user exertion.

19 Claims, 22 Drawing Sheets

(51) Int. Cl.
*A47C 3/02* (2006.01)
*A47C 17/72* (2006.01)

(58) Field of Classification Search
CPC ..... A47C 4/04; A47C 17/64; A47B 3/083; A47B 13/16; A47B 37/04; A47B 3/12; A47B 3/04; A47B 2003/045
USPC ..... 248/164, 431, 432
See application file for complete search history.

(56) References Cited

U.S. PATENT DOCUMENTS 4,544,203 A * 10/1985 Younger ..... A47G 9/1009 403/348
5,421,273 A * 6/1995 Lin ..... A47B 3/04 403/170
5,851,052 A 12/1998 Gustafsson
7,384,097 B2 6/2008 Park et al.
7,828,377 B2 11/2010 Grace

* cited by examiner

COMPACT FURNITURE

CROSS-REFERENCE TO RELATED APPLICATIONS

This application claims priority to U.S. Provisional Patent Application Ser. No. 62/910,805, filed on Oct. 4, 2019, entitled "COMPACT FURNITURE WITH SHOCK CORD" currently pending, and U.S. Provisional Patent Application Ser. No. 62/911,482, filed on Oct. 7, 2019, entitled "COMPACT FURNITURE WITH HUB" currently pending, the entire disclosures of which are incorporated herein by reference.

BACKGROUND OF THE INVENTION

When purchasing furniture items for camping (cots, chairs, tables), consumers are interested in items that fold into a compact size in the style of backpacking furniture for storage and transport. Consumers also generally prefer if such furniture can still fold out to the size of conventional, full-size camping furniture when assembled.

Existing products on the marketplace incorporate shock-corded pole elements, telescoping elements, modular or removable pieces, and/or various scissor frame configurations (among other things) into cots, chairs, tables, and the like in order to facilitate folding the furniture into a more compact form. The resulting furniture often has comparable pack dimensions to backpacking-style furniture when packed, or it has comparable assembled dimensions to conventional-style camping furniture when assembled, but not both.

Many of the methods used to achieve a compact design require the user to create tension on the fabric elements of a cot, chair, or table by manually stretching the fabric or by some mechanism that requires similar user exertion. This additional exertion can make setup difficult or even prohibit people without the strength necessary from setting up and using the item on their own.

SUMMARY OF THE INVENTION

In a first embodiment, the compact furniture hereof uses shock-corded poles in combination with one or many torsion spring mechanisms to achieve a compact pack size while also assembling to a size comparable with conventional full-sized furniture. Additionally, one or many torsion spring mechanisms associated with the furniture allow the user to achieve tension over desired elements of the furniture while reducing user exertion.

In a second embodiment, the compact furniture hereof uses shock-corded poles in combination with one or many central hubs to achieve a compact pack size while also assembling to a size comparable with conventional full-sized furniture. In this second embodiment, the hubs may utilize a locking mechanism to keep the legs and/or supports in an assembled position to reduce shifting and increase stability.

BRIEF DESCRIPTION OF THE DRAWINGS

For a better understanding of the present invention, reference may be made to the following accompanying drawings.

DETAILED DESCRIPTION OF THE INVENTION

Figure 1A:
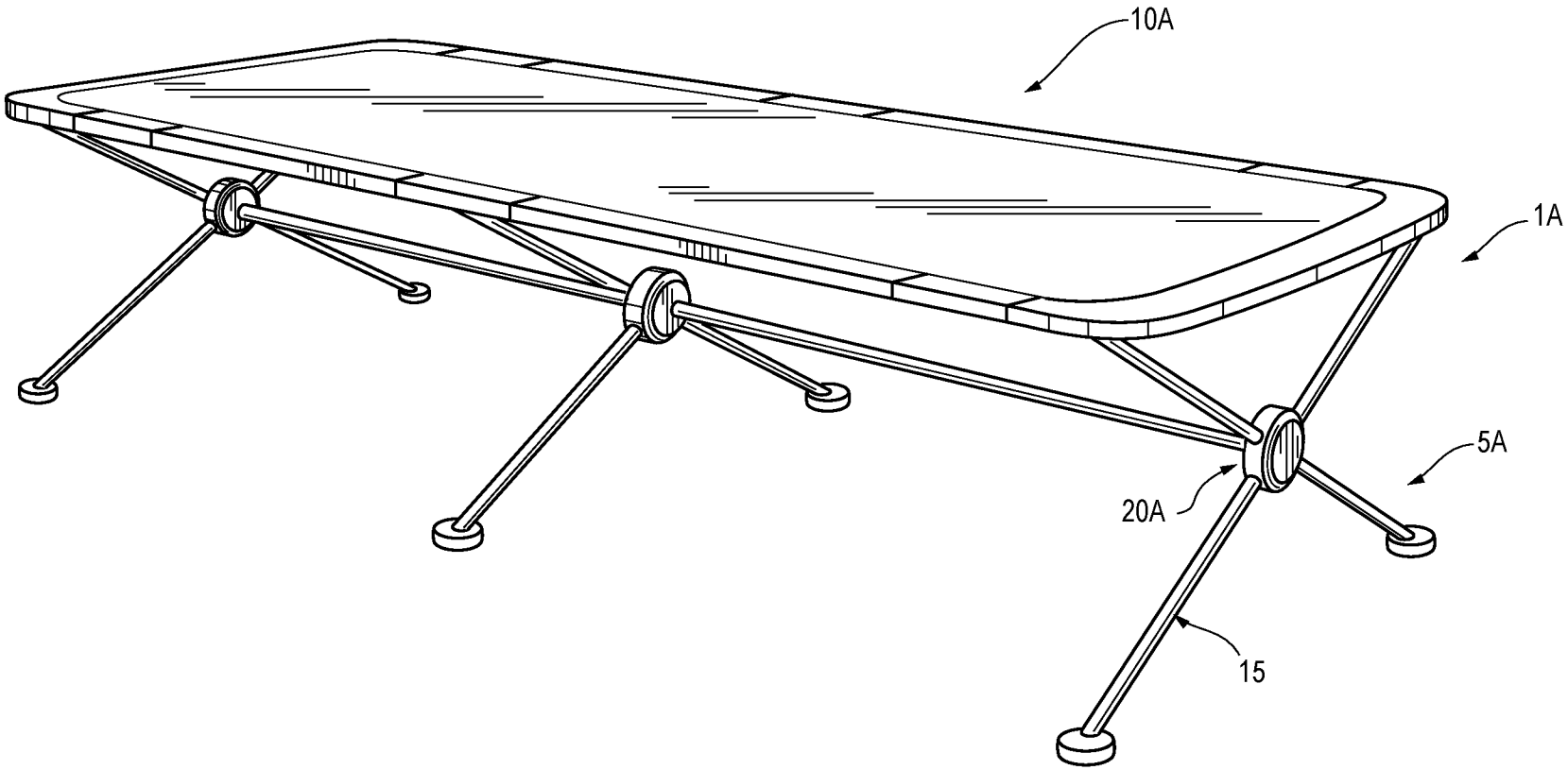
FIG. 1A is a cot that may be folded into compact form constructed according to the teachings of the current invention.
Figure 1B:
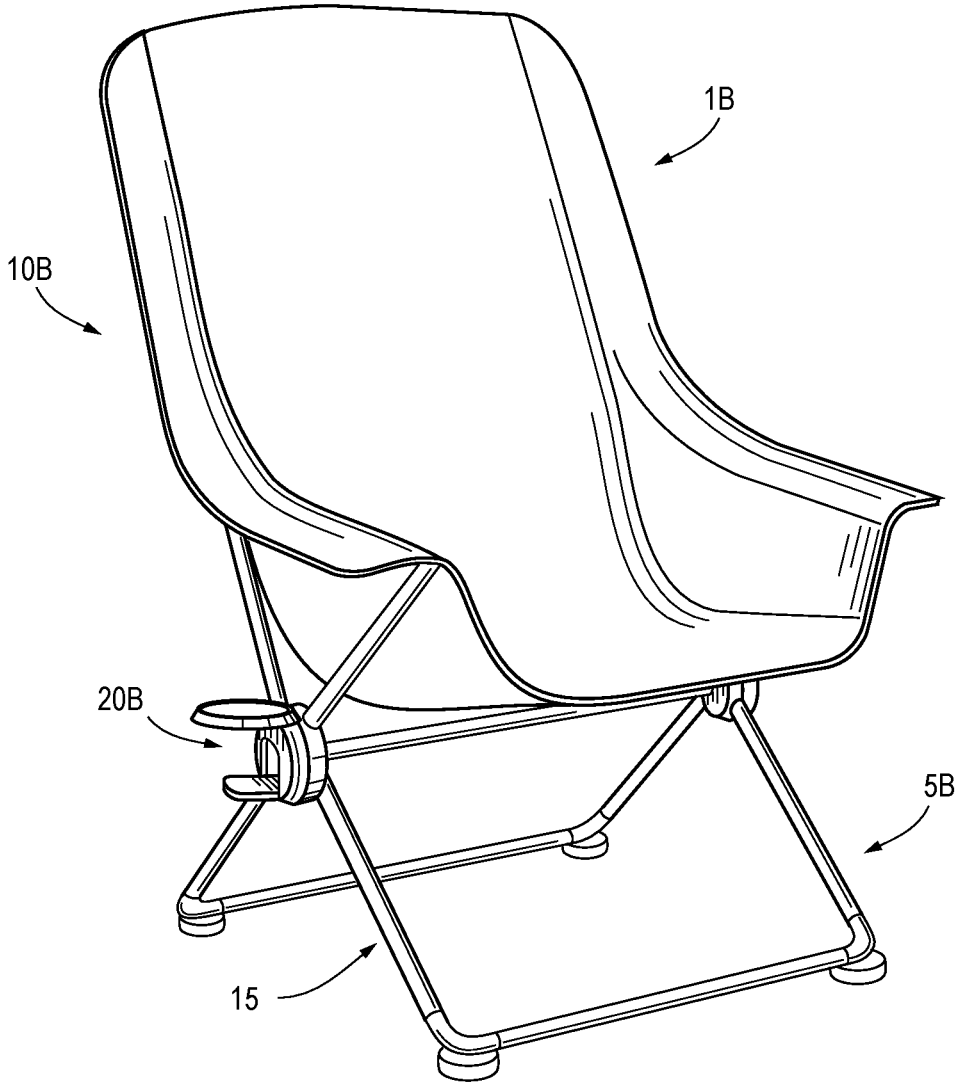
FIG. 1B is a chair that may be folded into compact form constructed according to the teachings of the current invention.
Figure 1C:
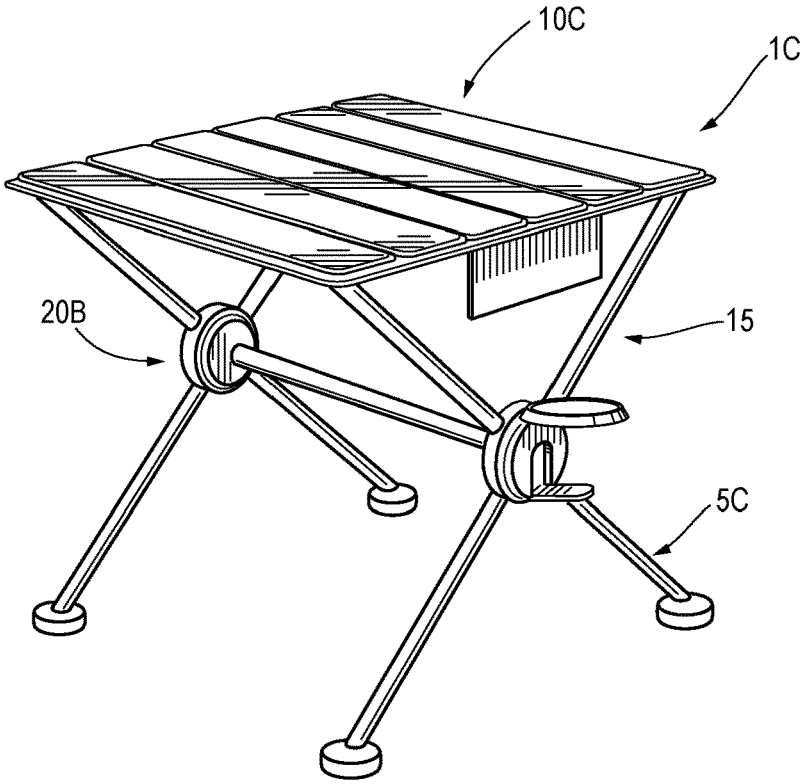
FIG. 1C is a table that may be folded into compact form constructed according to the teachings of the current invention.

FIGS. 1A, 1B, and 1C illustrate various types of foldable furniture that may be compacted such that it is more easily packed and toted than existing foldable furniture. Beginning with FIG. 1A, a cot 1A is provided that generally consists of a frame member 5A and a fabric cover 10A. The frame member 5A is made up of a plurality of rod members 15, some of which are connected to one another via a connection mechanism 20A. The connection mechanism 20A, described in detail below, facilitates the efficient folding of the furniture, such as the cot 1A.

FIG. 1B illustrates a chair 1B that similarly consists of a frame member 5B and a fabric cover 10B, as well as rod members 15, and connection mechanisms 20B. A table 1C is also illustrated in FIG. 1C that includes a frame member 5C that may support a fabric, rubber, plastic, or metal (e.g., aluminum) cover 10C. The table 1C, like the cot 1A and the chair 1B, may include rod members 15 and connection mechanisms 20A and 20B that allow the table 1C to be compactly folded and stowed.

Figure 3A:
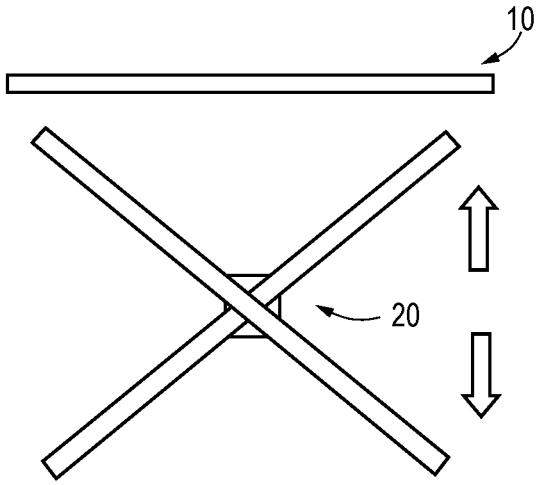
FIG. 3A is a cross-section elevation view of the connection mechanism of FIGS. 2A and 2B in an over-rotated form.
Figure 3B:
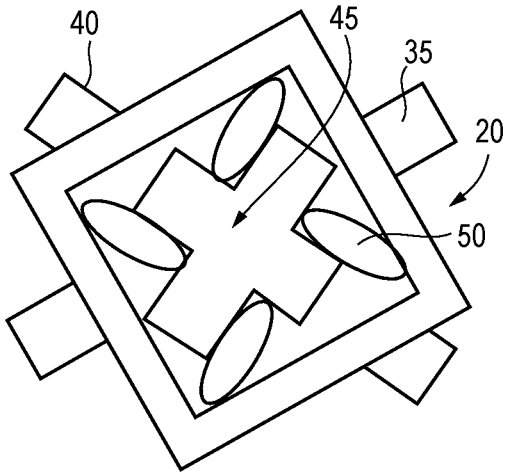
FIG. 3B is a cross-section top plan view of the connection mechanism of FIG. 3A in its over-rotated form.
Figure 4A:
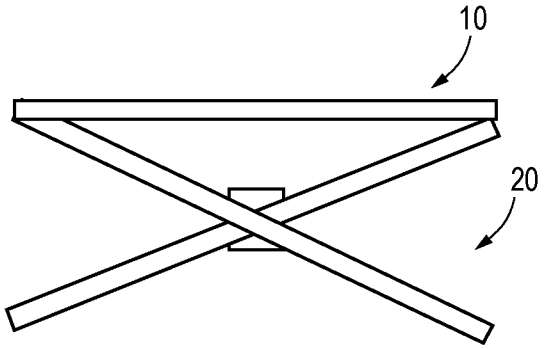
FIG. 4A is a cross-section elevation view of the connection mechanism of FIGS. 2A-3B in an assembled form.
Figure 4B:
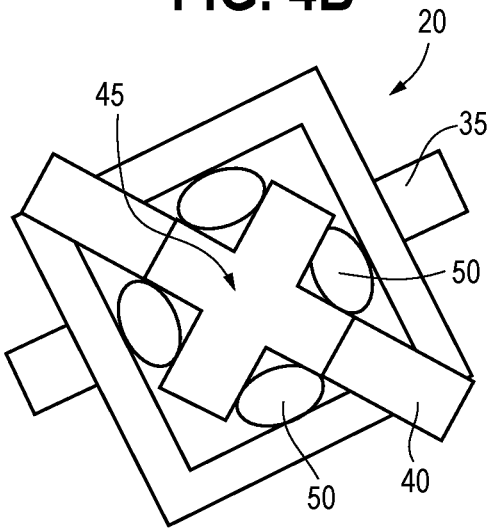
FIG. 4B is a cross-section top plan view of the connection mechanism of FIG. 4A in its assembled form.

As shown, the cot 1A utilizes connection mechanism 20A, while the chair 1B and the table 1C utilize the connection mechanism 20B. The differences between the connection mechanisms 20A and 20B is set forth below, but for the purposes of describing the invention, FIGS. 2-6 illustrate an exemplary connection mechanism 20 that may be used with any of the furniture 1A, 1B, or 1C. FIGS. 2-4 more particularly illustrate the manner in which the connection mechanism 20 may act to support a representative fabric cover 10 (which may embody any of the fabric covers 10A, 10B, or 10C).

Figure 2A:
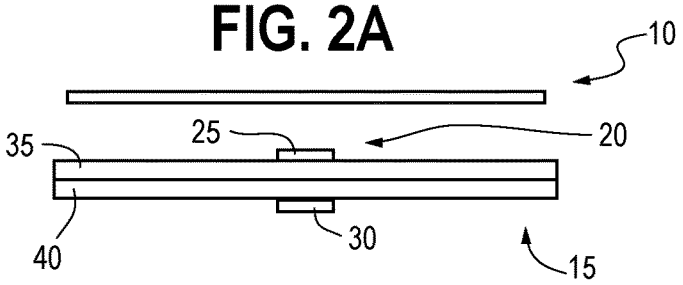
FIG. 2A is a cross-section elevation view of a connection mechanism of the furniture of FIGS. 1A-1C in a relaxed form.
Figure 2B:
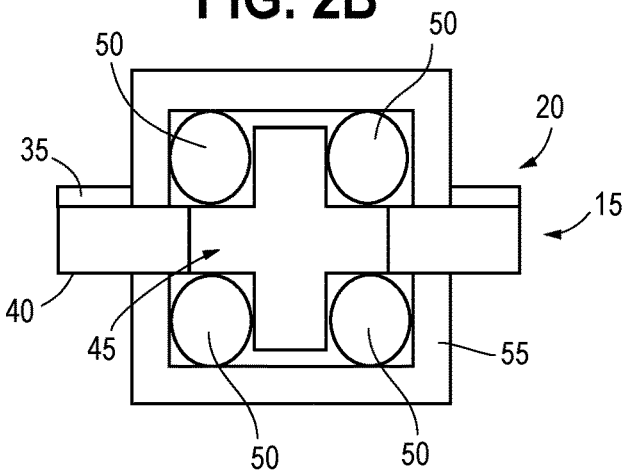
FIG. 2B is a cross-section top plan view of the connection mechanism of FIG. 2A in its relaxed form.

FIGS. 2A and 2B illustrate the connection mechanism 20 in its relaxed position. There is no load on the rod members 15 and in turn no load on the connection mechanism 20. The connection mechanism 20 generally includes each of an upper portion 25 and a lower portion 30 that may be releasably engaged with one another. The upper portion 25 and the lower portion 30 may generally be described as "upper" and "lower" relative to one another, but they may be configured in a side-by-side arrangement, or the upper portion 25 and the lower portion 30 may be switched (upper to lower and lower to upper) as the orientation is not paramount to the structure of the connection mechanism 20.

A first upper rod member 35 may extend through the upper portion 25 of the connection mechanism 20, and a lower rod member 40 may extend through the lower portion 30 of the connection mechanism 20. In some embodiments, the rod members 35, 40 may be comprised of two separate rod portions. In the relaxed position, the upper rod member 35 and the lower rod member 40 are preferably substantially parallel to one another, though in some embodiments, they may be slightly off-parallel to one another, for example in a narrow "X-shape," which may still be characterized as substantially parallel. As provided in FIG. 2B, the connection mechanism 20, in addition to the rod members 35, 40, may be provided with an internal plus shaped member 45, a plurality of cylindrical rubber stoppers 50, and an external housing 55.

In order to manipulate the connection mechanism 20 and its associated rod members 35, 40 so that they are deployed in the manner illustrated in FIGS. 1A, 1B, and 1C, a user may first rotate the connection mechanism 20 by using the rods 35, 40 as lever arms. When the rods 35, 40 are rotated relative to one another, the support rod (in this embodiment rod 40), which may extend through or otherwise be in mechanical connection with the plus shaped member 45, causes the plus shaped member 45 to rotate within the tubing 55. Other foreseeable means of transmission to rotate the plus shaped member 45 are envisioned herein. As the rod 40 rotates, the rubber stopper members 50 may be compressed. This mechanism is illustrated in greater detail in FIGS. 3A and 3B. In FIGS. 3A and 3B, the rod members 40, 35 have been over-rotated relative to one another such that the rubber stop members 50 are in a substantially compressed form.

Because the rubber stop members 50 have spring-like properties and are biased to return to their circular form illustrated in FIG. 2B, the rubber stopper members 50 may apply an outward force on the plus shaped member 45 and thus the rod 40 relative to the rod 35. Until counter-tension is applied to the connection mechanism 20, without further interference, the connection mechanism 20 and the rod members 35, 40 will return to the relaxed form illustrated in FIGS. 2A and 2B.

However, when counter-tension is applied, the rod members 35, 40 may be deployed as illustrated in FIGS. 1A, 1B and 1C. To retain the rod members 35, 40 in a deployed form, counter-tension may be applied to the connection mechanism 20 by the fabric cover 10. The specific manner in which the fabric cover 10 may be releasably attachable with the rod members 35, 40 may vary greatly. However, as a few non-limiting examples, the fabric cover 10 and the rod members 15 (in this case the rod members 35, 40) may be releasably attachable using hook and loop fasteners, buttons, magnets, ties, or other known or foreseeable means. The fabric cover 10 may create the steady counter-tension needed to support furniture such as the furniture illustrated in FIGS. 1A, 1B, and 1C. In order to return the furniture to its position as illustrated in FIGS. 2A and 2B, a user may simply take the reverse steps as described above, more particularly by detaching the fabric cover 10 from the connection mechanism 20 and allowing the rod members 35, 40 to return to the relaxed form of FIGS. 2A and 2B.

Figure 5:
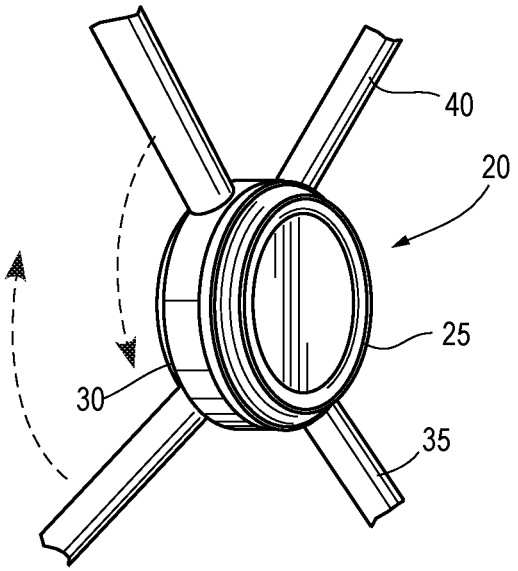
FIG. 5 is a perspective view of the connection mechanism illustrating the manner in which the connection mechanism is rotatable.
Figure 6:
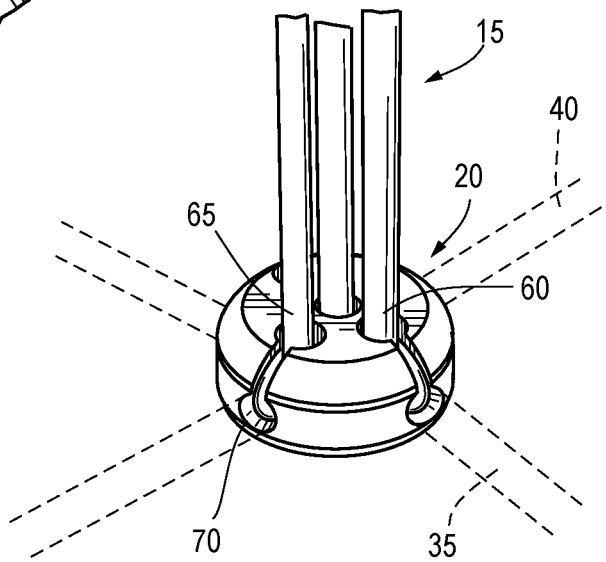
FIG. 6 is a perspective view of the connection mechanism of FIG. 5 illustrating the manner in which support rods may be stored in the connection mechanism.

FIG. 5 illustrates the connection mechanism 20 and the rod members 40, 35 of the connection mechanism 20 in the process of rotating. As illustrated, the rod member 40 is associated with the lower portion 30 of the connection mechanism 20, and the rod member 35 is associated with the upper portion 25 of the connection mechanism 20.

In order to facilitate packing, one of the upper member 25 and the lower member 30 of a connection mechanism 20 may be provided with a plurality of receiver members 60 that are sized and shaped to receive end portions 65 of the rod members 15. Apertures 70 may receive and engage the rod members 15 when they are deployed in the manner illustrated in FIG. 5. However, because the rod members may be connected to the rod 40 (not illustrated in FIG. 6) by a shock cord such as that illustrated in FIG. 7, end portions 65 may be removable from the apertures 70 and extended to the receiver members 60 where they may be received and engaged in a compacted form. Each of the rod members 35, 40 may be compacted in this manner using the shock cord 75.

Figure 7:
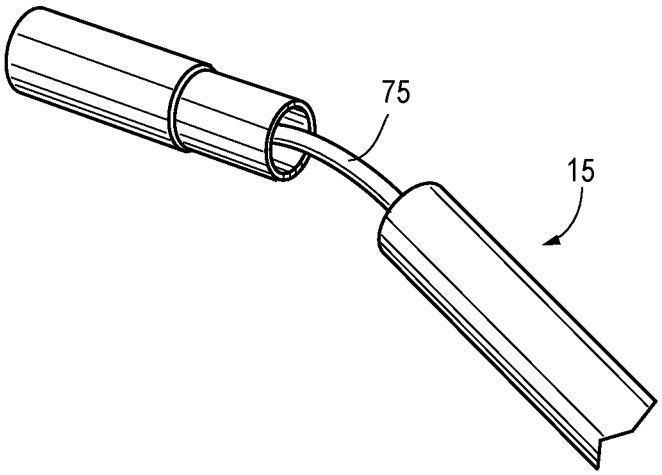
FIG. 7 is a perspective view of a shock-cord connection that may be used in the furniture of FIGS. 1A-1C.
Figure 8:
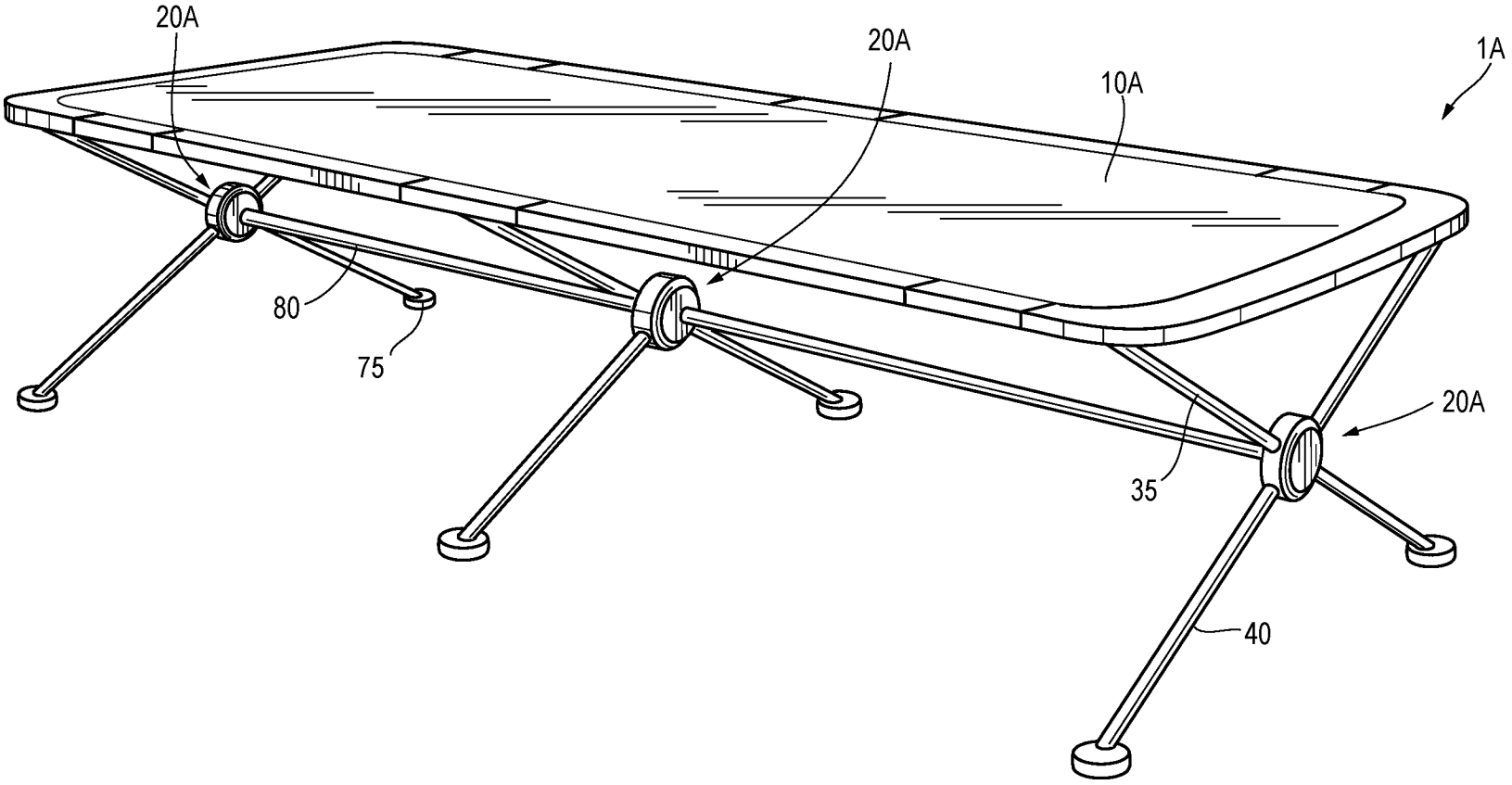
FIG. 8 is a perspective view of a cot constructed including the connection mechanism.

For the cot 1A illustrated in FIG. 8, the connection mechanism 20A is illustrated as supporting the rod members 35, 40 in a deployed position so as to support the fabric cover 10A. For the cot 1A, three connection members 20A and three rod members 35, 40 are preferably provided. Between adjacent connection members 20A, rod members 80 that are elongated may also be provided. The rod members 80 may be comprised of shock cords 75 in much the same manner as illustrated in FIG. 7. Because the elongated rod members 80 include shock cord 75, the elongated members 80 may be broken down to a shortened length when the cot 1A is in its compact form.

Figure 9:
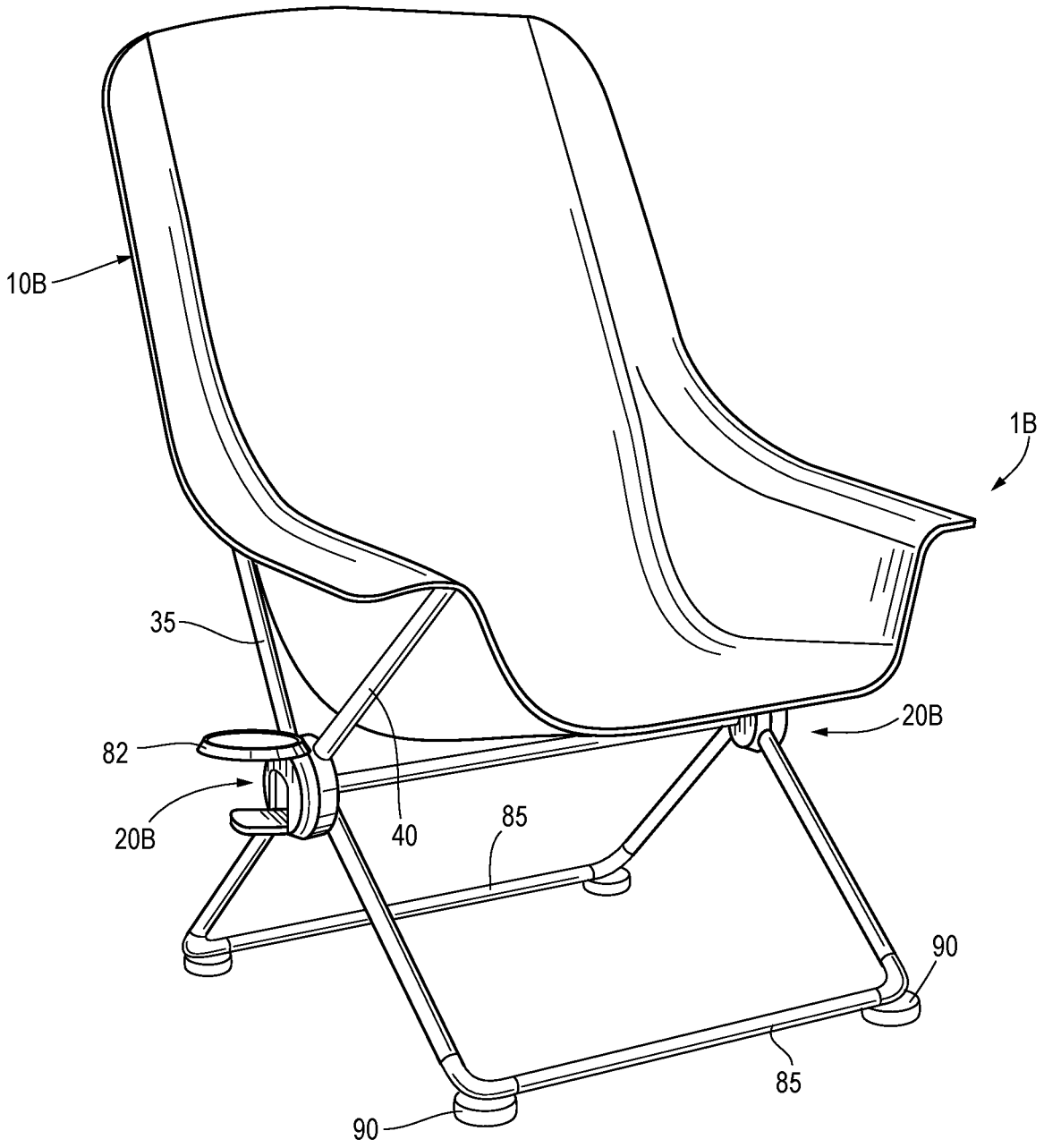
FIG. 9 is a perspective view of a first embodiment of a chair constructed including the connection mechanism.
Figure 10:
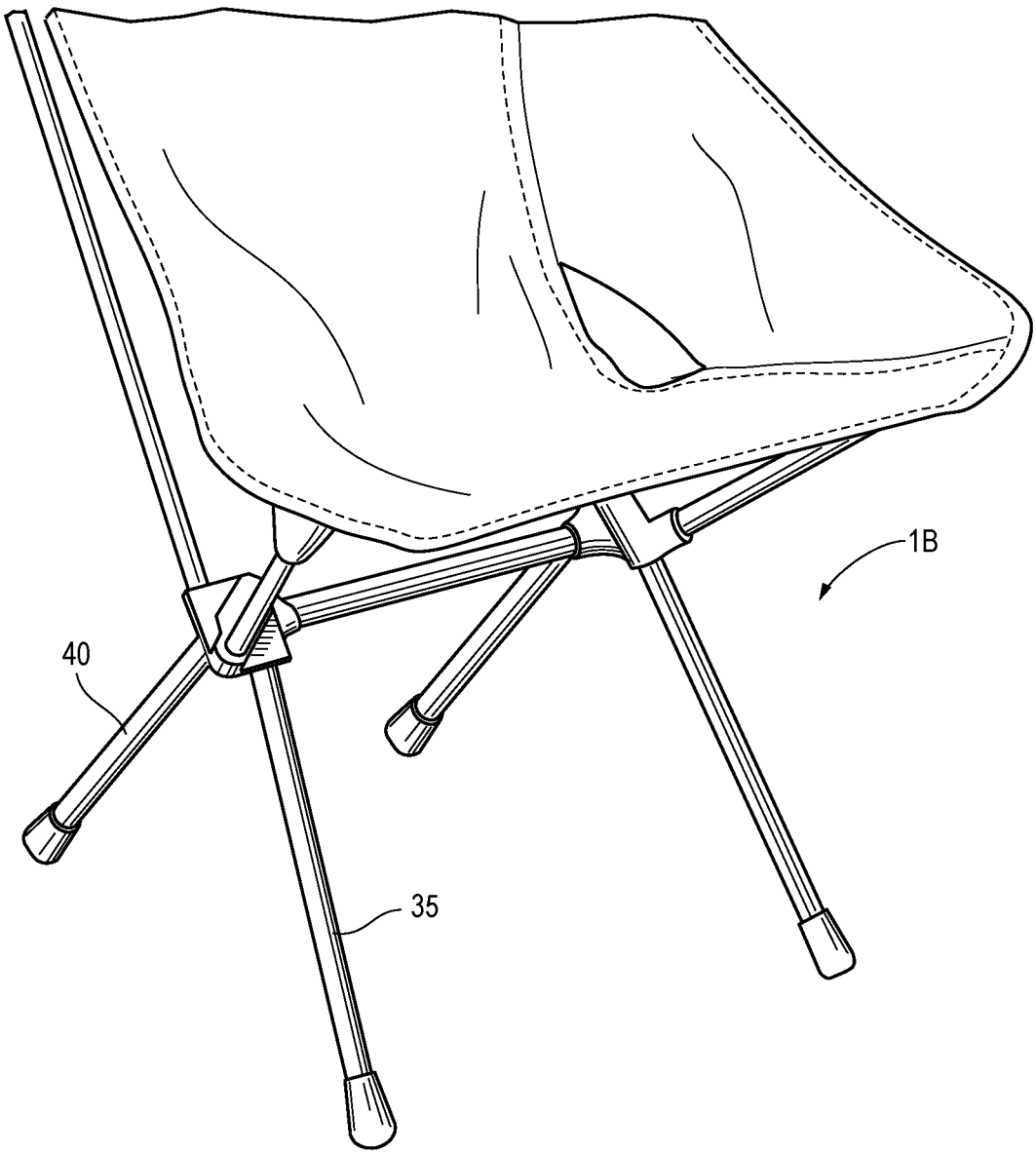
FIG. 10 is a partial perspective view of a second embodiment of a chair constructed including the connection mechanism.

Turning to FIG. 9, the chair 1B is illustrated. The chair 1B may include two connection mechanisms 20B. The connection mechanisms 20B are unique as compared to the previous connection mechanisms 20A in that they include a cup holder 82 that is integrated into each connection mechanism 20B. In at least one embodiment, the connection mechanism 20A of the cot 1A may be provided with a cup holder such as the cup holder 82. Each of the connection mechanisms 20B may be associated with a rod member 35 and a rod member 40. In the embodiment illustrated in FIG. 9, base rod members 85 may also be provided that attach the rod members 35, 40 from either connection mechanism 20B to one another. Joints 90 may be provided to serve as connections between those same rods 85. The rods 85 may be broken down so as to be the same length as the rod members or substantially the same length as the rod members 35, 40 when detached from the joint members 90. Additional rod members (not illustrated) may also be provided that may be made into a shorter form as a result of being comprised of shock cord 75. Those additional rod members may be located substantially behind the fabric cover 10B that forms the seat 1B. In the alternative embodiment of FIG. 10, no connection members 85 are provided between rod members 35, 40 that form the leg members of the chair 1B.

Figure 11:
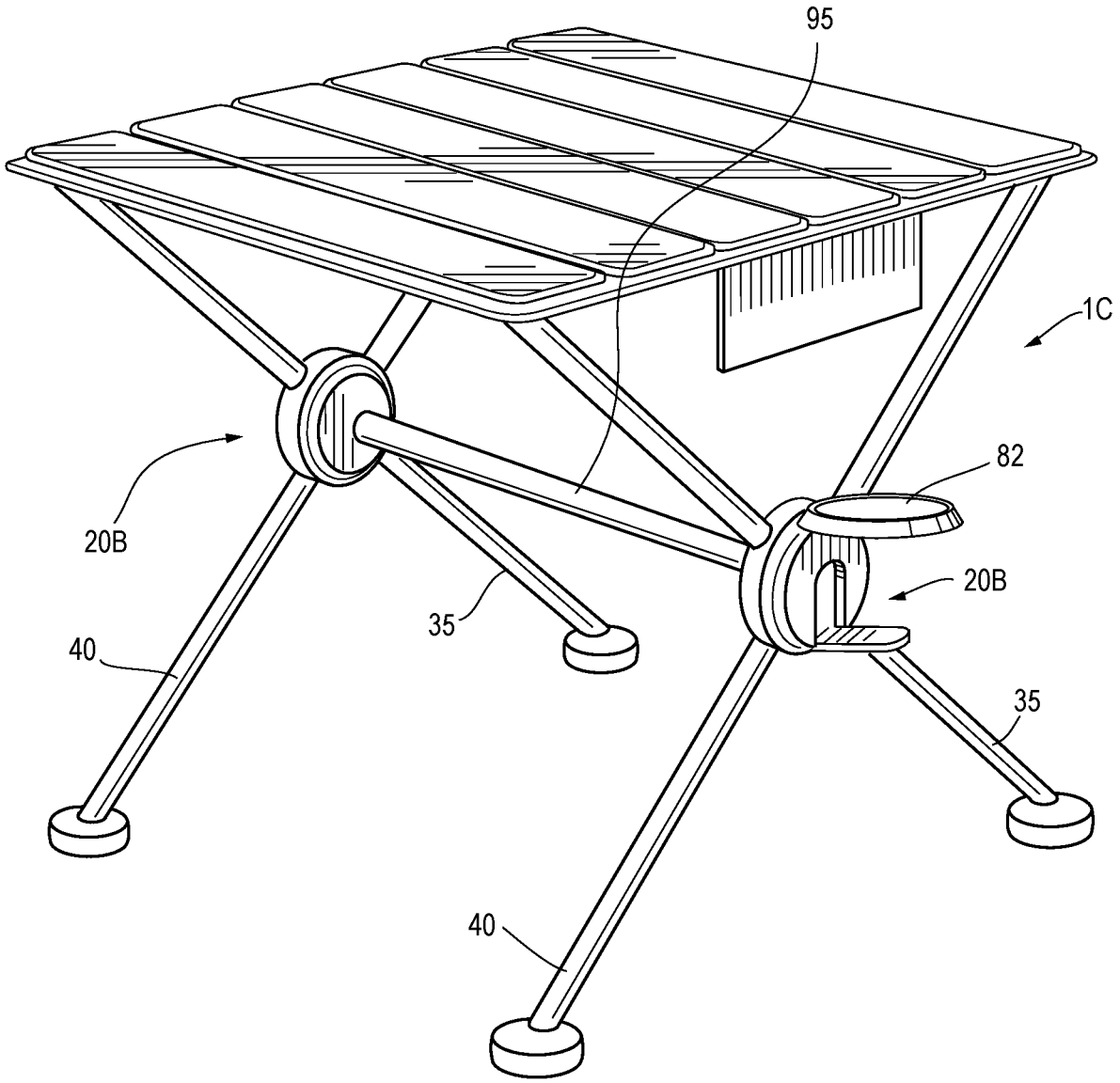
FIG. 11 is a perspective view of a first embodiment of a table constructed including the connection mechanism.

FIG. 11 illustrates a table 1C that also uses connection mechanisms 20B to attach the rod members 35, 40 of one side of the table 1C to the rod members 35, 40 on the other side of the table 1C. An additional rod member 95 is also provided that connects the connecting mechanisms 20C to one another.

Figure 12:
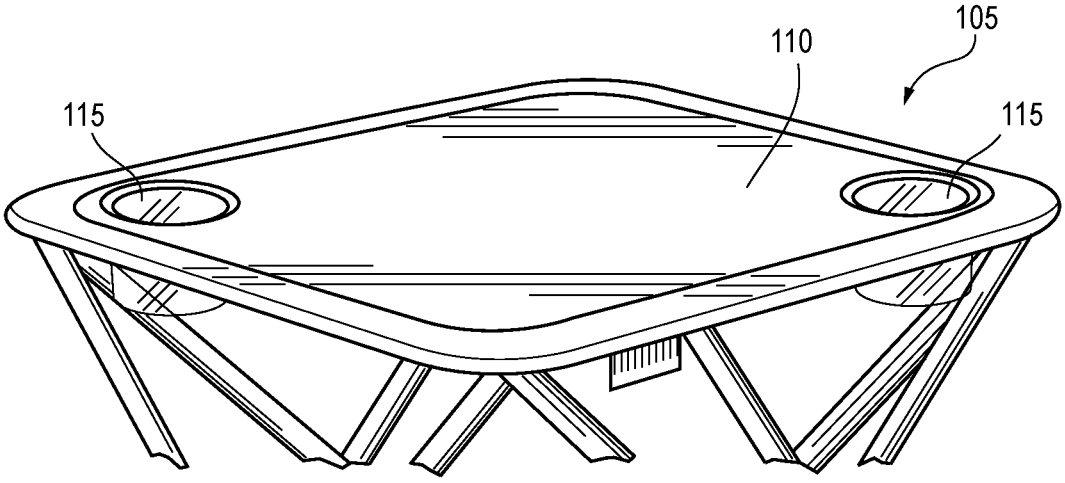
FIG. 12 is a partial perspective view of a second embodiment of a table constructed including the connection mechanism.

In FIG. 12, an alternative table 105 is illustrated. Unlike the table 1C illustrated in FIG. 11, a cover that may act to counter the tension provided in the table 105 includes cup holders 115 built therein.

Figure 13:
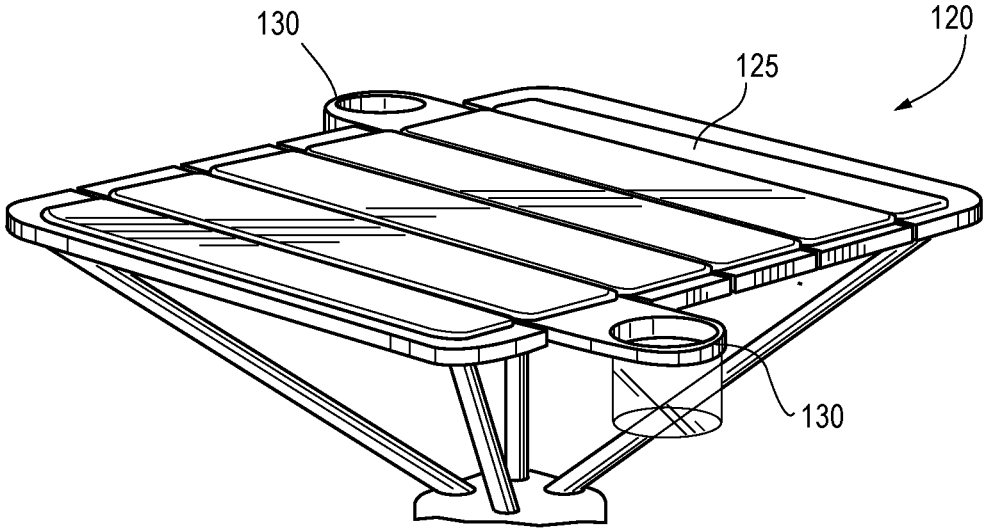
FIG. 13 is a partial perspective view of a third embodiment of a table constructed including the connection mechanism.
Figure 14A:
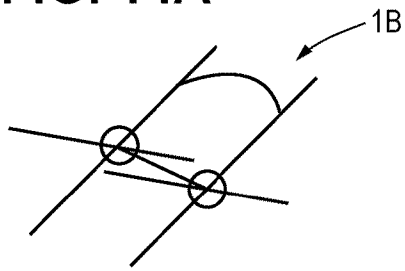
FIG. 14A is a schematic of an embodiment of a non-rocking chair.
Figure 14B:
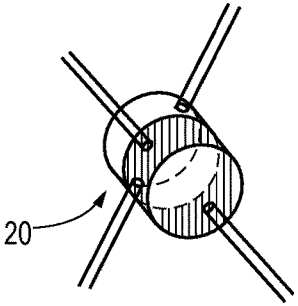
FIG. 14B is a schematic of a connection mechanism that may be used with the chair of FIG. 14A.

In FIG. 13, yet another alternatively constructed table 120 is illustrated. A cover 125 of that table 120 includes cup holders 130 that extend from side portions of the table 120. While FIGS. 11-13 illustrate some manners in which cup holders may be provided on the tables 1C, a multitude of alternative embodiments may be provided where cup holders are attached or associated with the tables in alternative manners.

Figure 15A:
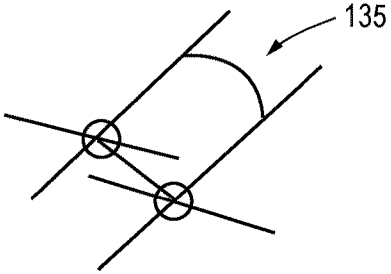
FIG. 15A is a schematic of a first embodiment of a rocking chair.
Figure 15B:
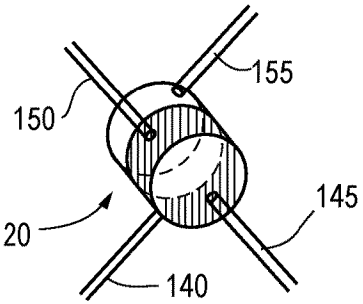
FIG. 15B is a schematic of a connection mechanism that may be used with the chair of FIG. 15A.
Figure 16A:
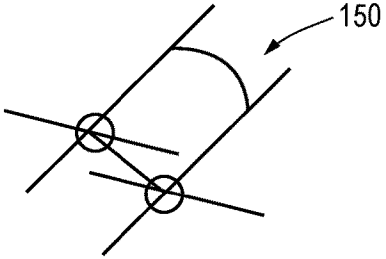
FIG. 16A is a schematic of a second embodiment of a rocking chair.
Figure 16B:
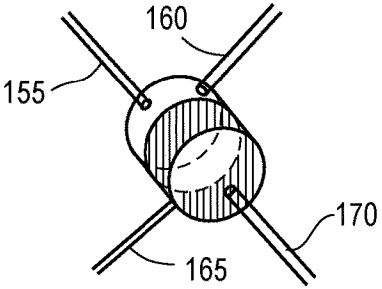
FIG. 16B is a schematic of a connection mechanism that may be used with the chair of FIG. 16A.
Figure 17:
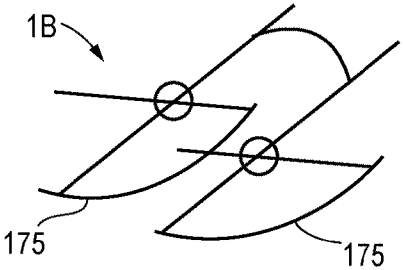
FIG. 17 is a schematic of a third embodiment of a rocking chair.

Turning to FIGS. 14-17, a chair similar to the chair 1B is provided that may be modified to obtain a rocking feature. FIGS. 14A and 14B substantially illustrate the chair 1B as provided, while FIGS. 15-17 illustrate modifications to the chair and connection mechanism that introduce a rocking feature. FIG. 15A provides a first method for converting the chair to a rocking chair 135. The chair 135 uses the same connection mechanism 20 as the standard chair 1B, but reconfigures the supports and legs to introduce rocking. In this design, as illustrated in FIG. 15B, a front leg support 140 is moved to the same side of the connection mechanism 20 as a rear leg support 145 and a front chair support 150, leaving a back chair support 155 alone. This allows the back of the chair 135 to move independently of the legs and front of the chair 135, introducing a rocking motion while maintaining the tensioning feature. This may or may not be combined with fabric and webbing elements to allow the fabric cover to stretch to accommodate rocking or to hold the back in place when rocking is not desired.

Another reconfiguration of a chair using the same connection mechanism 20 is illustrated in FIGS. 16A and 16B. Both chair supports 155, 160 are on one portion of the connection mechanism 20 and both leg supports 165, 170 are on the other portion, allowing the chair supports 155, 160 to move independently of the legs 165, 170. This introduces a rocking motion, but does not maintain the tensioning feature. This may or may not be combined with fabric and webbing elements to allow the fabric cover to stretch to accommodate rocking or to hold the back in place when rocking is not desired.

The method illustrated in FIG. 17 is the same chair frame as the non-rocking configuration chair 1B, but with the addition of rocker bars 175, which may be completely removable or may be shock corded to the rest of the frame. These rocker bars 175 may or may not serve as the method by which the chair 1B keeps the connection mechanism 20 compressed (as opposed to the fabric). This would allow the chair 1B to have a loose, draping fabric seat as opposed to a tensioned fabric seat while still locking the frame into place.

In alternative embodiments, adjusting the inner workings of the connection mechanism 20 or the durometer of the rubber within the connection mechanism 20 may also be used alone or in combination with one of the other methods, to introduce some rocking functionality to the chair frame.

Figure 18A:
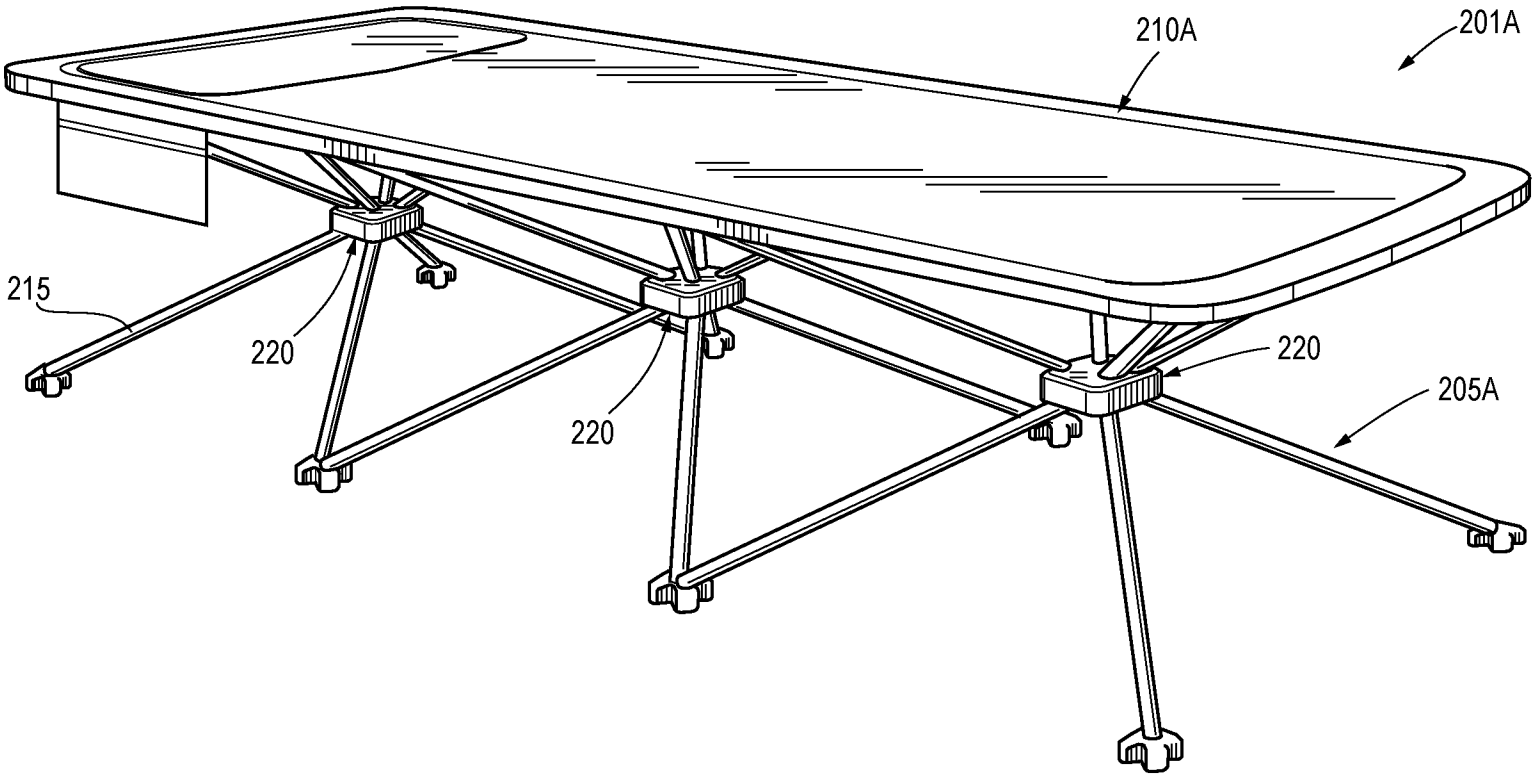
FIG. 18A is a cot that may be folded into compact form constructed according to the teachings of the current invention.
Figure 18B:
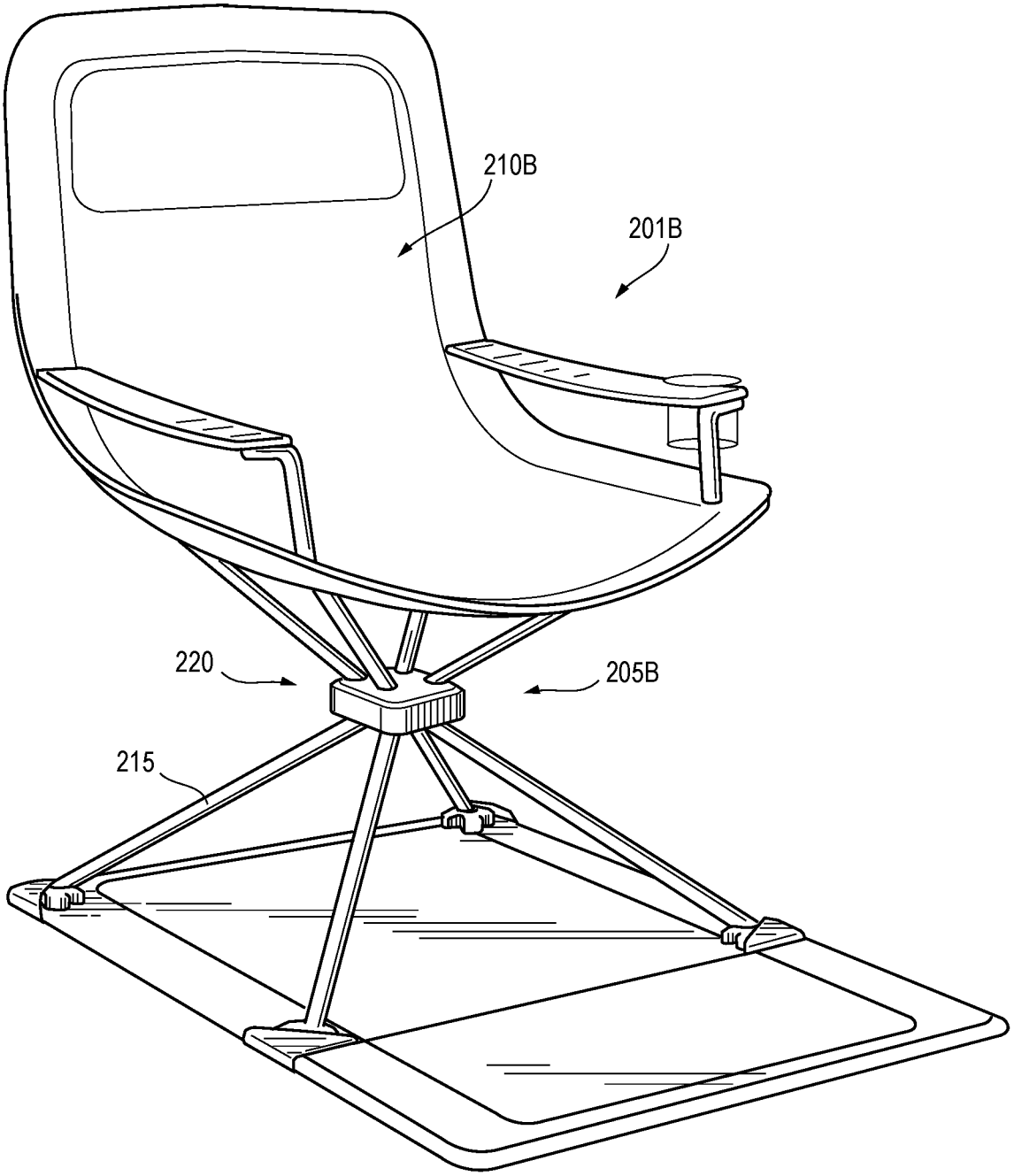
FIG. 18B is a chair that may be folded into compact form constructed according to the teachings of the current invention.
Figure 18C:
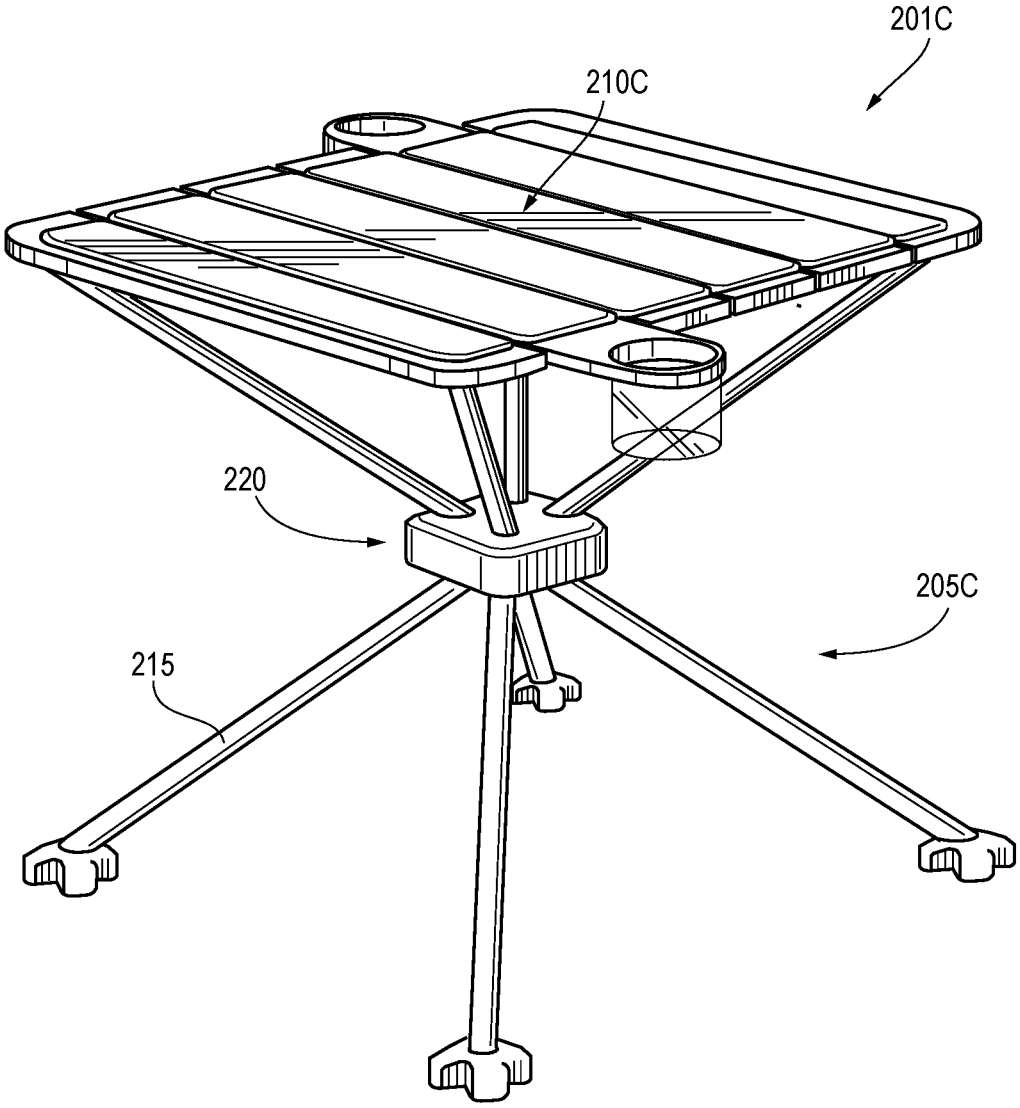
FIG. 18C is a table that may be folded into compact form constructed according to the teachings of the current invention.

FIGS. 18A, 18B, and 18C illustrate various types of foldable furniture that may be compacted such that it is more easily packed and toted than existing foldable furniture. Beginning with FIG. 18A, a cot 201A is provided that generally consists of a frame member 205A and a cover 210A. The frame member 205A is made up of a plurality of rod members 215, some of which are connected to one another via hub mechanisms 220. The hub mechanism 220 (or in the case of the cot 201A, multiple hub mechanisms 220), described in detail below, may facilitate the efficient folding of the furniture such as the cot 201A.

FIG. 18B illustrates a chair 201B that similarly consists of a frame member 205B and a cover 210B, as well as rod members 215 and a hub mechanism 220. A table 201C is also illustrated in FIG. 18C that includes a frame member 205C that may support a fabric, metal, or rubber cover 210C. The table 201C, like the cot 201A and the chair 201B, may include rod members 215 and a hub mechanism 220 that allows the table 201C to be compacted.

Figure 19:
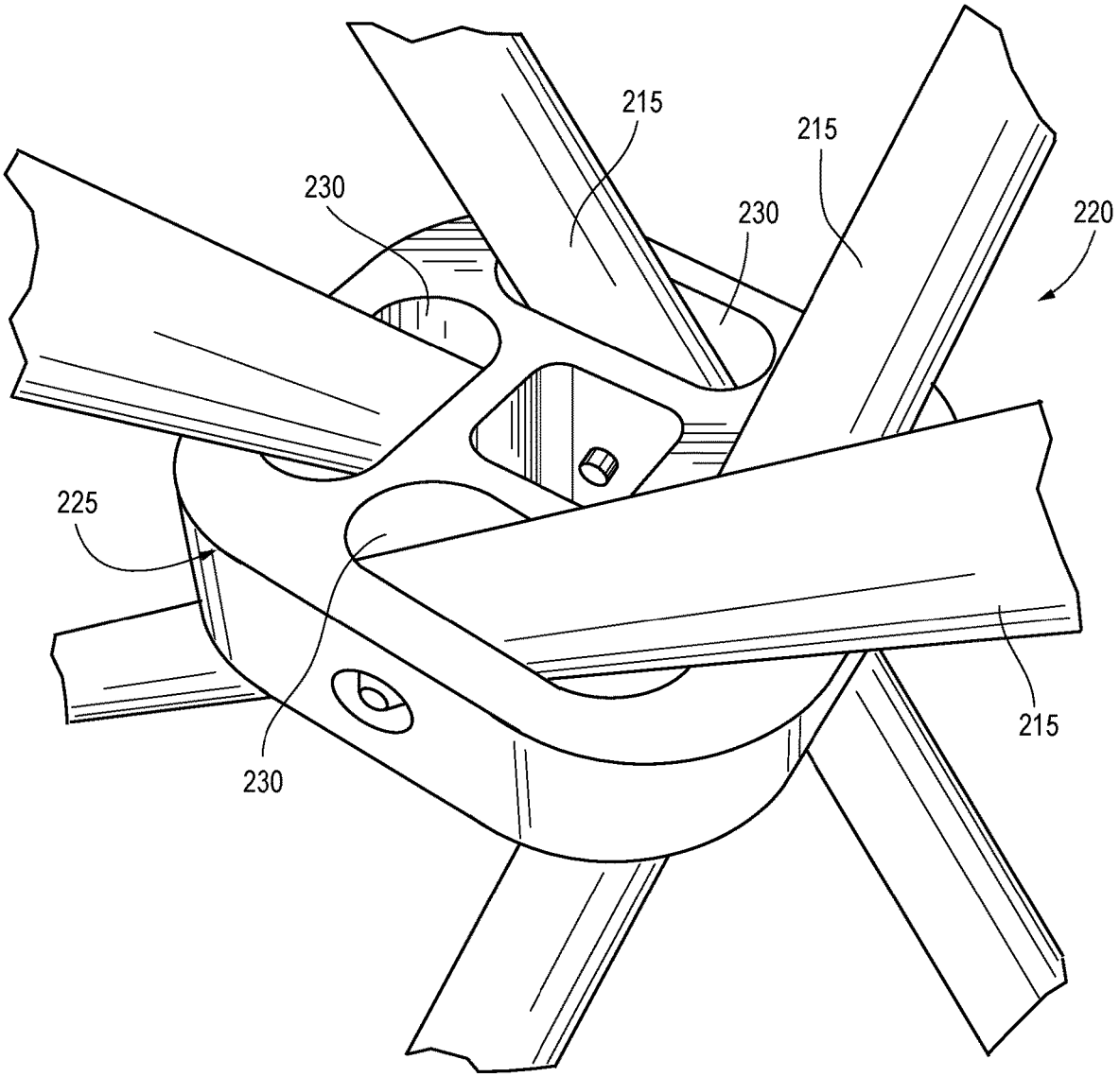
FIG. 19 is a perspective view of a hub mechanism of the furniture of FIGS. 18A-18C.

FIG. 19 illustrates an exemplary hub mechanism 220 that may be used with any of the furniture 1A, 1B, or 1C. The hub mechanism 220 may include a central hub 225 that is constructed of a single element and includes multiple through holes 230 to allow support rods 215 to pass there through. The illustrated hub mechanism 220 includes four through holes 230 and four support rods 215, though more or fewer of either are foreseeable in alternative embodiments. The support rods 215 may be permanently or semi-permanently affixed within each through hole 230 via known or foreseeable mechanisms.

Figure 20:
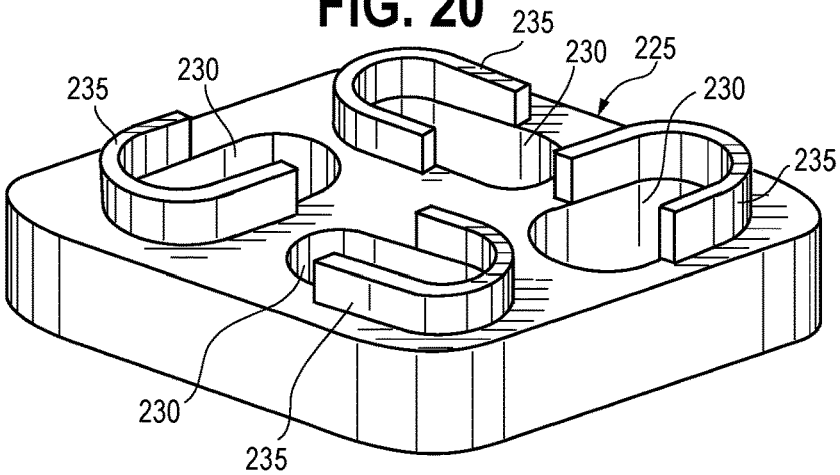
FIG. 20 is a perspective view of a first locking mechanism that may be used with the hub mechanism of FIG. 19.
Figure 21:
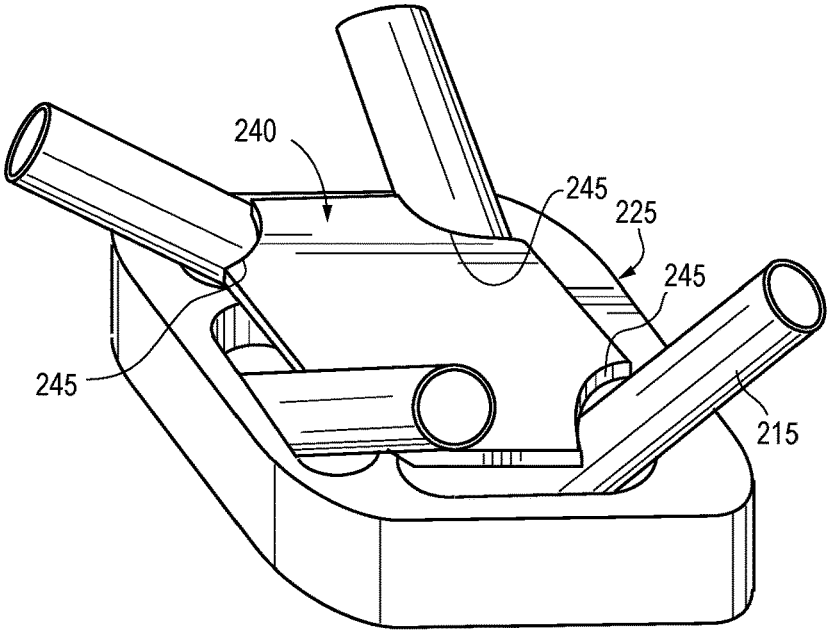
FIG. 21 is a perspective view of a second locking mechanism that may be used with the hub mechanism of FIG. 19.
Figure 22:
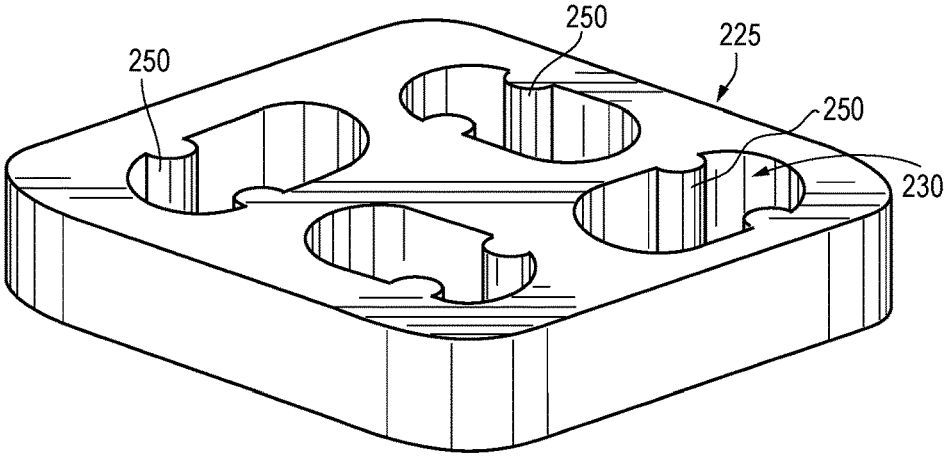
FIG. 22 is a perspective view of a third locking mechanism that may be used with the hub mechanism of FIG. 19.

The central hub 225 may include a locking mechanism such as the various mechanisms illustrated in FIGS. 20-22 to keep the rods 215 in a deployed form when furniture such as cot 201A, chair 201B, or table 201C are assembled. Turning first to FIG. 20, a plurality of press-fit clips 235 are illustrated that may be selectively retained within the through holes 230 of the central hub 225. The clips 235 may be retained within the holes 230 through known or foreseeable attachment mechanisms. The press-fit clips 230 may be substantially "U-shaped." They are preferably of a size and shape that allows the rod members 215 (not illustrated in FIG. 20) to be retained therein when deployed, but are out of the way when the rod members 215 are collapsed for storage and/or carriage.

FIG. 21 provides an alternative locking mechanism, a locking plate 240, for the rod members 215. The locking plate 240 preferably is of a size and shape that allows it to be friction-fit or otherwise (e.g., twisted, screwed, or clipped) attached to the central hub 225. The locking plate 240 preferably includes rounded corners 245 that are curved to allow rod members 215 to nestle therein when deployed. The rounded corners 245 may prevent the rod members 215 from returning to a collapsed form when the locking plate 245 is engaged with the central hub 225.

In yet another embodiment illustrated in FIG. 22, bumper members 250 may be retained within the through holes 230. The bumper members 250 may be permanently or semi-permanently attached to the interior of the through holes 230. The bumper members 230 should be sufficiently thick to allow a user to push a rod member 215 past the bumper members 250 when he or she wishes to deploy the rod member 215. However, the bumper members 230 should be sufficiently resilient to keep the rod members 215 in a deployed position until they are returned to a compact form by an operator.

Figure 23:
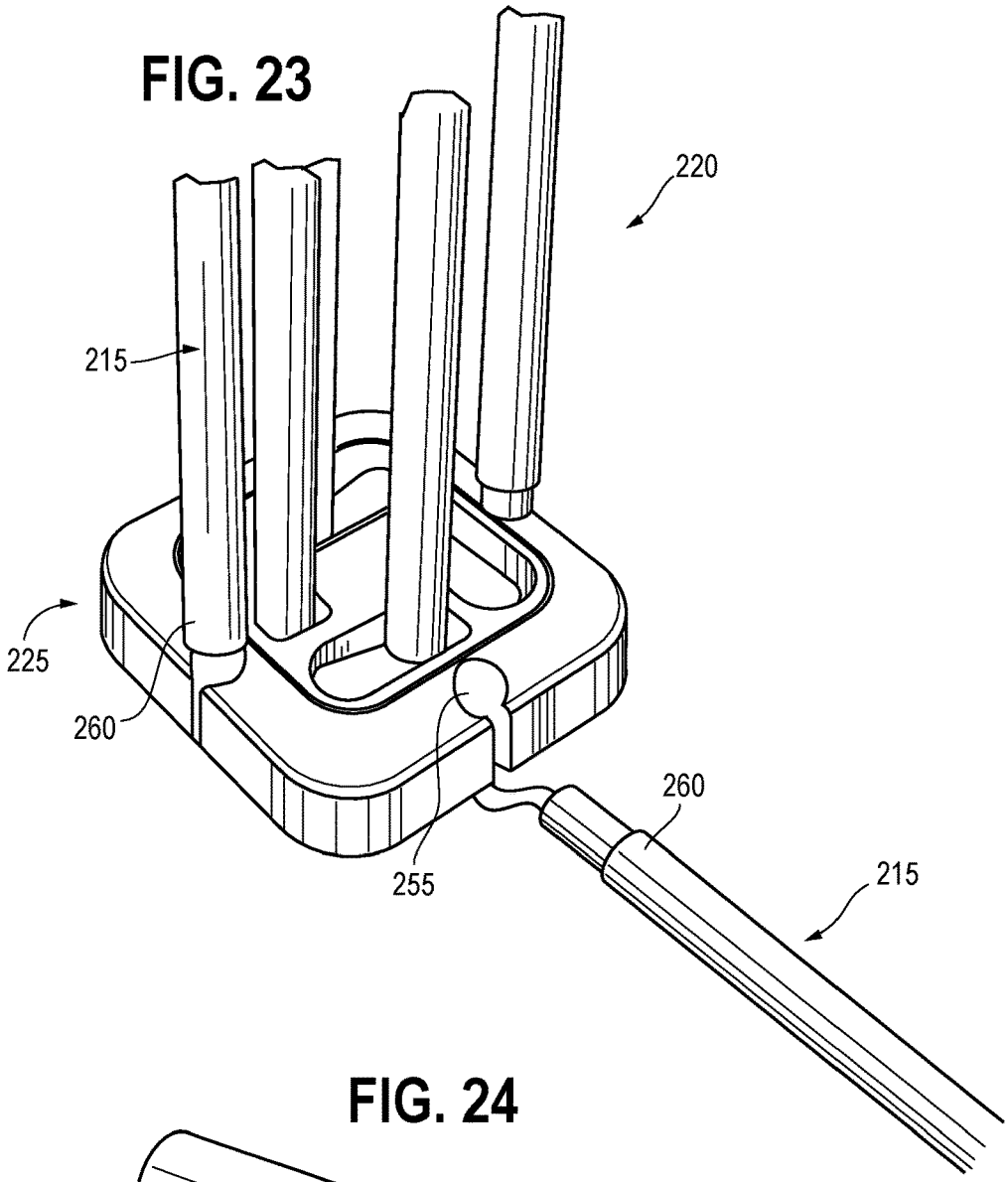
FIG. 23 is a perspective view of the hub mechanism of FIG. 19 illustrating the manner in which support rods may be stored in the hub mechanism.
Figure 24:
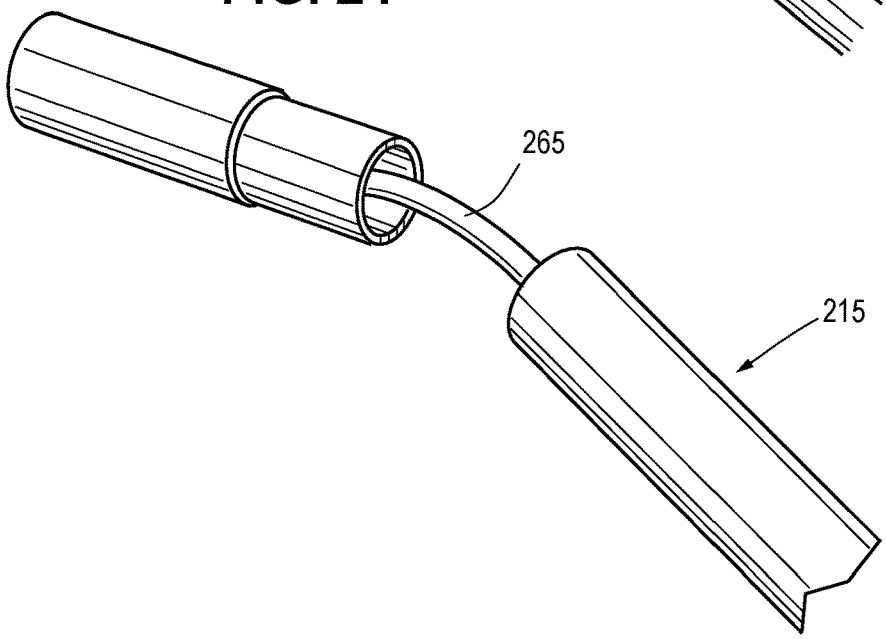
FIG. 24 is a perspective view of a shock-cord connection that may be used in the furniture of FIGS. 18A-18C.

As can be seen in FIG. 23, in order to facilitate packing, one side (or in some embodiments, both sides) of the central hub 225 of a connection mechanism 220 may be provided with a plurality of receiver members 255 that are sized and shaped to receive end portions 260 of the rod members 215 from an opposite side of the hub mechanism 220. The rod members 215 that are stored in the receiver members 255 may be connected to the central hub 225 by a shock cord such as shock cord 265 that illustrated in FIG. 24. That way, end portions 260 may be removable from one side of the central hub 225 and extended to the receiver members 255 on the other side of the hub 225 where they may be received and engaged in a compacted form. Each of the rod members 215 may be compacted in this manner using the shock cord 265. When in the collapsed form, the rod members 215 may be oriented in the same direction and allow for more efficient storage.

Figure 25:
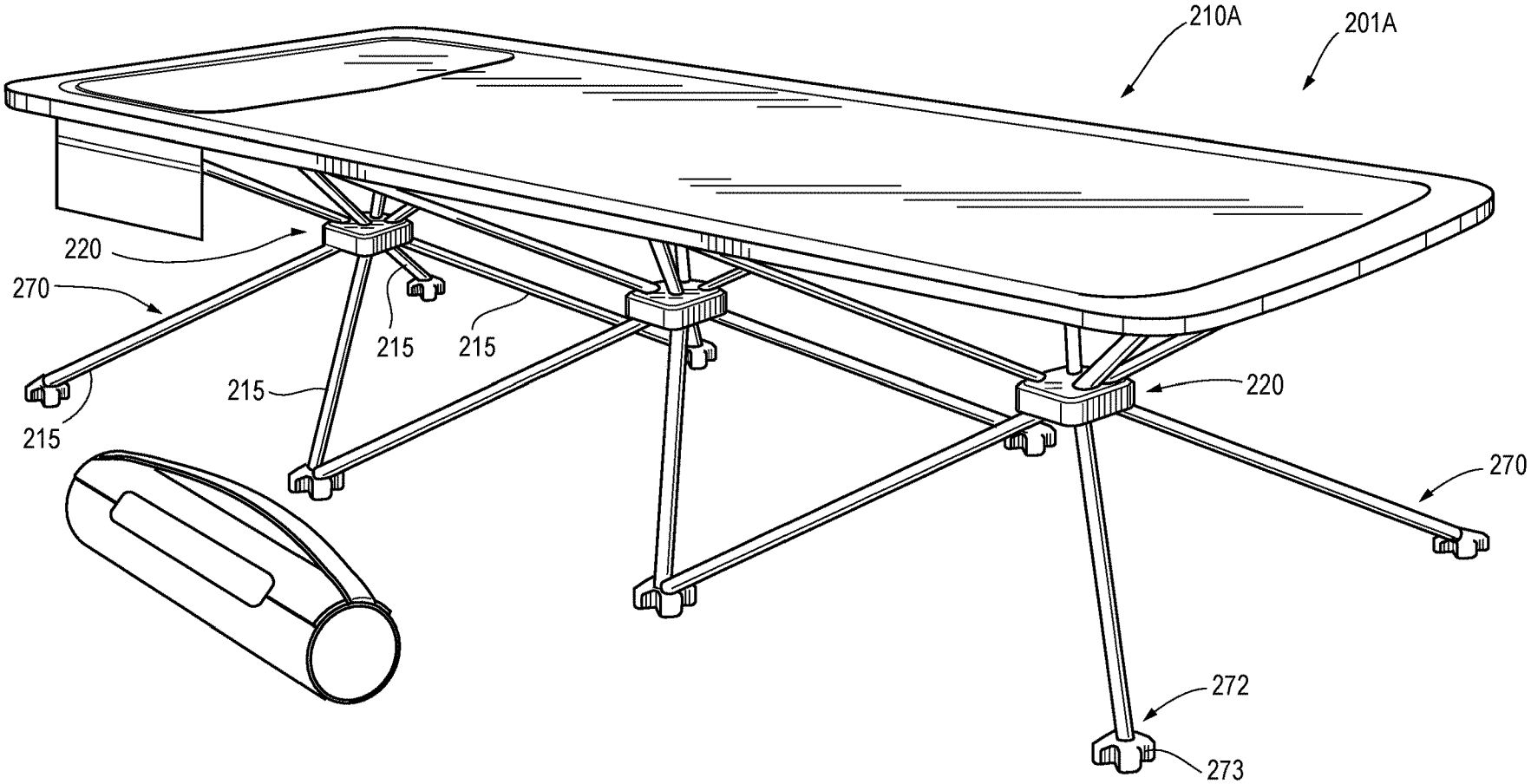
FIG. 25 is a perspective view of a cot constructed including the hub mechanism.

For the cot 201A illustrated in FIG. 25, the three hub mechanisms 220 support three leg assemblies 270. Each leg assembly 270 may include four support rods 215, each made of multiple segments that are removably connected to each other via the shock cord 265 (not illustrated). Each of the rod members 215 preferably passing through one of the four through holes 230 (not illustrated) in the central hub 225 of the hub mechanism 220 as described above. In some embodiments, the hub mechanisms 220 may further include cup holders.

Lower portions 272 of the rod members 215 that make up the leg assemblies 270 preferably include feet 273 attached thereto. The feet 273 preferably include notches (not illustrated) that may have a snap feature to receive other rod members 215 and keep the leg assemblies 270 neat when disassembled.

Figure 26:
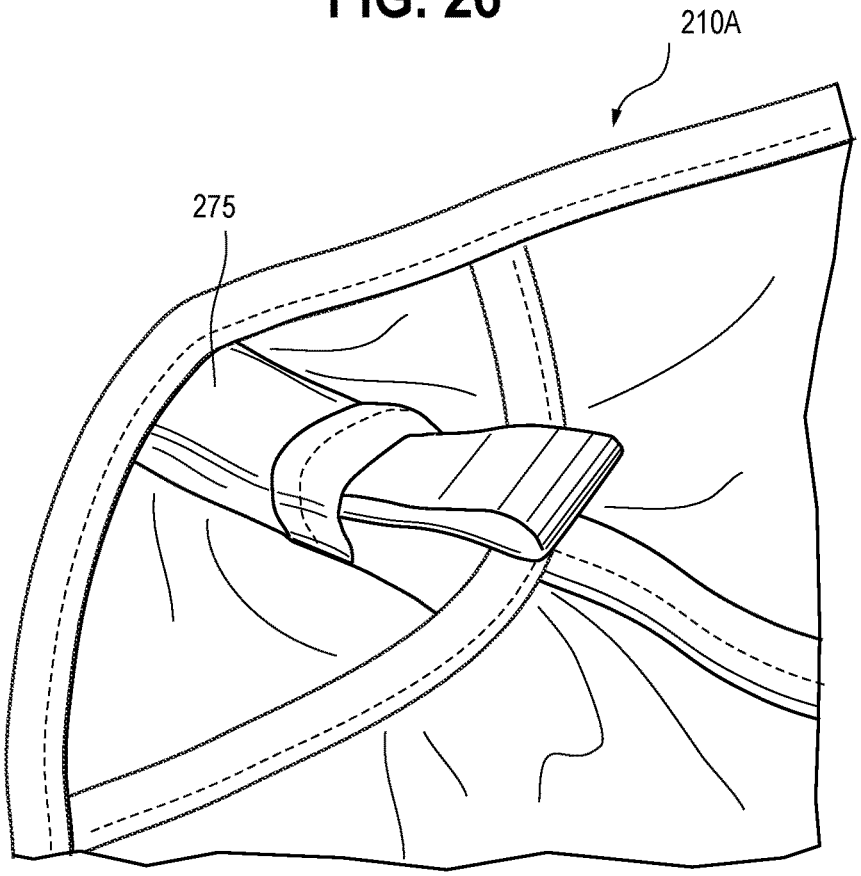
FIG. 26 is a perspective view of a first embodiment of a pocket and clip connection for use with the furniture of FIGS. 18A-18C.
Figure 27:
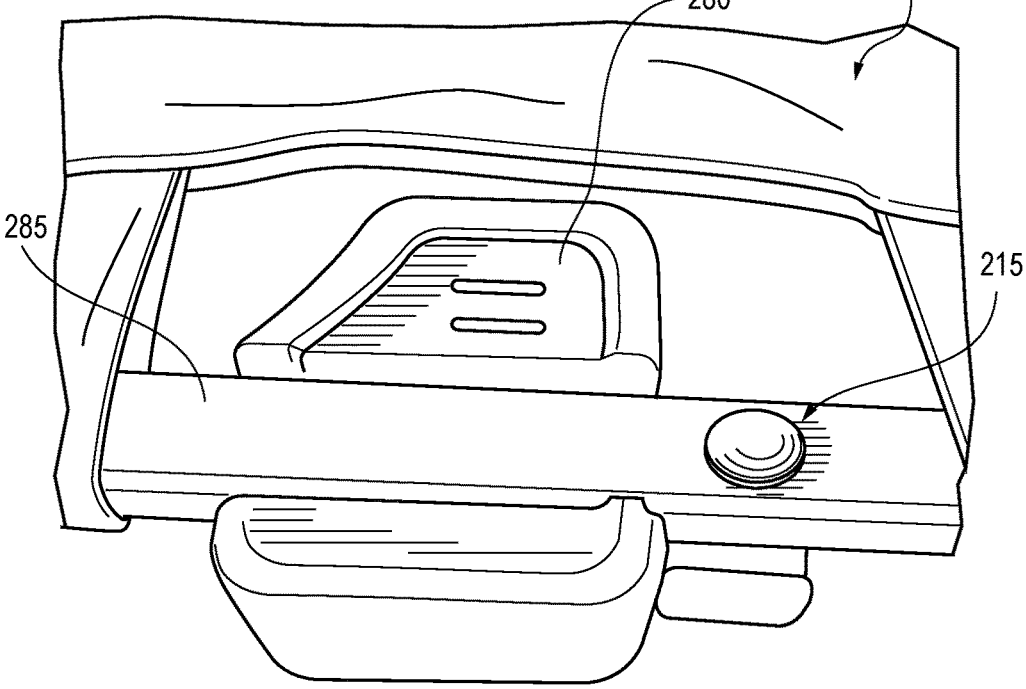
FIG. 27 is a perspective view of a second embodiment of a pocket and clip connection for use with the furniture of FIGS. 18A-18C.

The fabric 210A preferably includes connections to each of the four rod members 215 for each of the three leg assemblies 270. Examples of these connections are provided in FIGS. 26 and 27 as pockets 275 on the cover 210A that may receive portions of the rod members 215, and clips 280 on the rod members 215 that connect to side rails 285 threaded into the fabric element 210A.

To collapse the cot 201A, the fabric (or other material) cover 210A should be decoupled from the rod members 215. Then the rod members 215 may be collapsed by decoupling the shock cord 265 segments of each rod member 215 from one another. The rod members 215 may then be stored as shown and described in FIG. 23. It should be noted that in some embodiments, the cot 201A may roll up within its cover 210A, and the cover 210A may form a carry bag as illustrated in FIG. 25.

Figure 28:
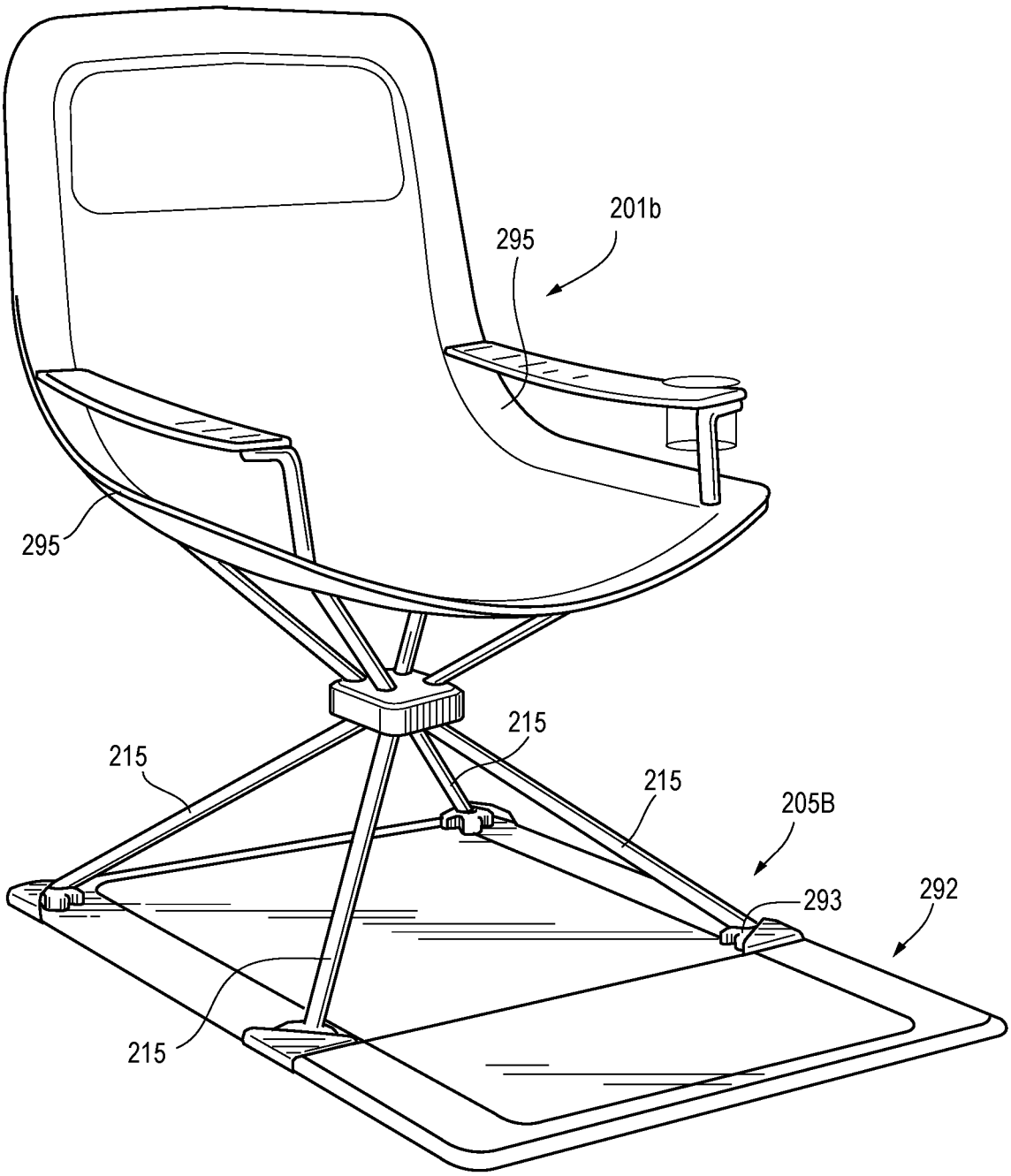
FIG. 28 is a perspective view of a chair constructed including the hub mechanism.

Turning to FIG. 28, the chair 201B is illustrated. The frame member 205B preferably includes four support rod members 215. The rod members 215 may be made of multiple segments that are removably connected to each other via a shock cord such as the shock cord 265. Each of the four rod members 215 may pass through one of the four through holes 230 in the central hub 225 (not illustrated). Like the cot 201A, the hub mechanism 220 of the chair 205B may include cup holders (not illustrated). The rod members 215 may be attached and detached from the cover 210B of the chair 201B in substantially the same described manners as the cot 201A. Similarly, the chair 201B may be collapsed and stored in substantially the same manner, even potentially using the cover 205B as a storage bag. The chair 201B may also be provided with a mat 292 that could prevent rod members 215 from digging into soft ground and further provide a clean surface for a user to rest his or her feet. The mat 292 may include pockets 293 for receiving and securing feet 273 like those of the cot 201A to further stabilize the chair 201B in place.

Figure 29:
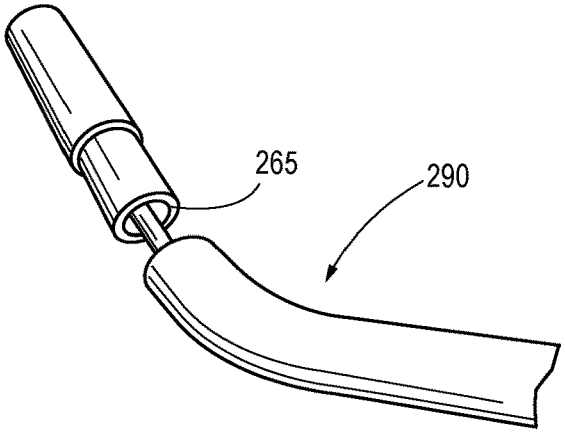
FIG. 29 is a perspective view of a shock-cord connection of a curved rod that may be used in the furniture of FIGS. 18A-18C.

As provided in FIG. 29, the chair 201B may include additional a curved support rod member 290 that may be made up of multiple segments that are connected via the shock cord 265. The curved support member 290 may be utilized to create the seat back that forms support for the chair 201B. In FIG. 28, though the rod members 290 are covered by fabric of the cover 210B, two support members may be provided at the seatback locations 295. The curved rod members 290 may be retracted to be easily stored with the other rod members 215.

FIG. 28 illustrates the table 201C that also uses the hub mechanism 220 with the rod members 215 to form the frame member 205C. The frame member 205C again may include four support rod members 215 that may be made of one or multiple segments that are removably connected to each other via the shock cord 265. The hub mechanism 220 and the rod members 215 may operate in substantially the same manner as for the cot 201A and the chair 201B to deploy and store the table 201C.

Figure 30:
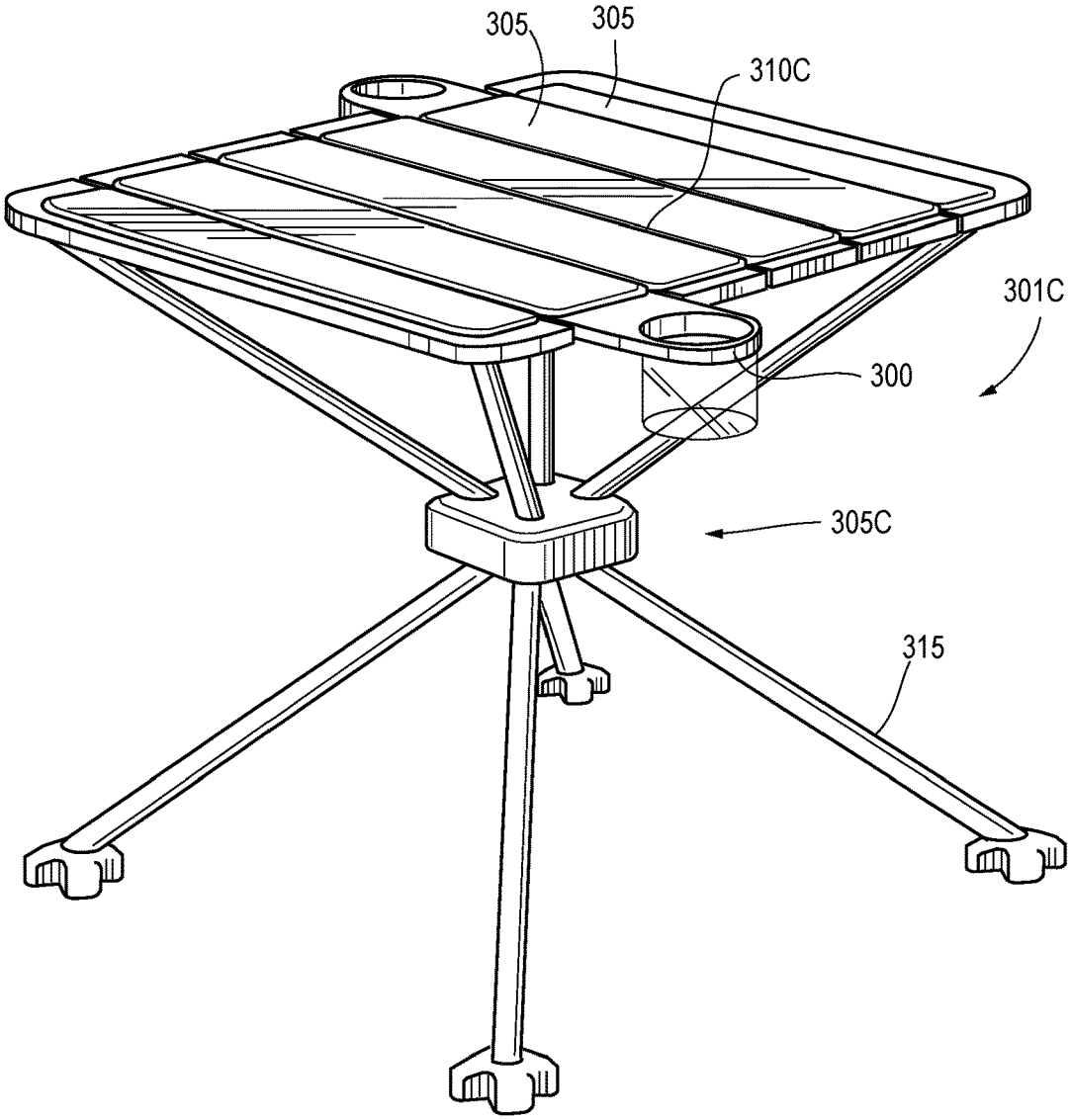
FIG. 30 is a perspective view of a table constructed including the hub mechanism.
Figure 31:
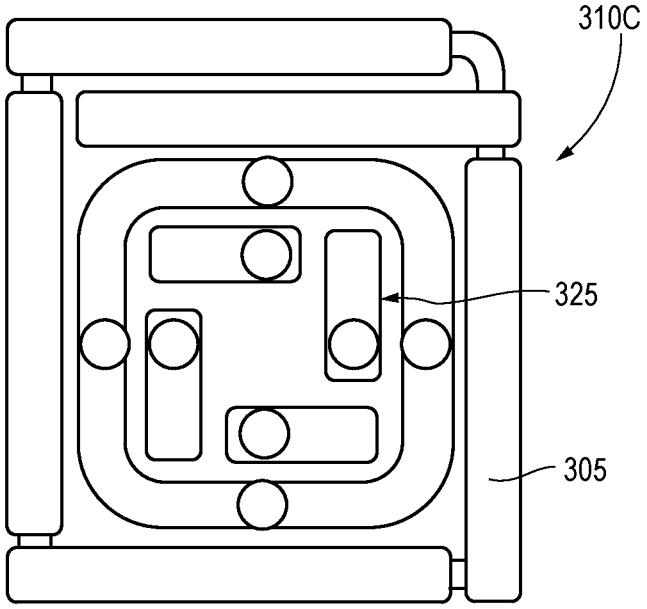
FIG. 31 is a plan view of the hub mechanism stored in a table top of the table of FIG. 30.

Unlike the other covers 210A, 210B, the table top cover 210C is illustrated as including cup holders 300 built into its surface. As provided in FIGS. 30 and 31, the cover 210C may be comprised of a number of aluminum slats 305 that are foldable relative to one another. As such, the cover 210C may be folded at the slats 305 when the rod members 215 are stowed to secure the hub mechanism 220 therein including the rod members 215.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles, and scope of the present invention.

Many changes, modifications, variations, and other uses and applications of the present invention will, however, become apparent to those skilled in the art after considering the specification and the accompanying drawings. All such changes, modifications, variations, and other uses and applications which do not depart from the spirit and scope of the invention are deemed to be covered by the invention, which is limited only by the claims which follow.

The invention claimed is:

1. A compact furniture system, the system comprising:
a frame member, the frame member including:
a plurality of rod members; and
a connection mechanism for connecting one or more of the plurality of rod members to one another; and
a fabric cover;
wherein the connection mechanism includes each of an upper member and a lower member such that an upper rod member may extend into the upper member of the connection mechanism, and a lower rod member may extend through the lower member of the connection mechanism;
wherein in a relaxed position, the upper rod member and the lower rod member are substantially parallel to one another; and
wherein in a rotated position, the upper member and the lower member are rotated relative to one another such that the upper rod member and the lower rod member are rotated relative to one another and are no longer substantially parallel to one another, and the fabric cover may be attached to the upper rod member and the lower rod member to retain the system in the rotated position; and
wherein the connection mechanism includes an internal plus shaped member which is engageable with one of the upper rod member and the lower rod member.

2. The system of claim 1, wherein at least one of the plurality of rod members includes two or more separate rod portions.

3. The system of claim 2, wherein the rod portions are connected by an elastic cord.

4. The system of claim 1, wherein the connection mechanism includes a plurality of cylindrical stoppers that abut the plus shaped member such that when the plus shaped member is rotated the cylindrical members compress.

5. The system of claim 4, wherein the cylindrical stoppers are made from a compressible material.

6. The system of claim 1, wherein one of the upper member and the lower member of the connection mechanism includes a plurality of receiver members that are sized and shaped to receive end portions of at least one of the plurality of rod members.

7. The system of claim 1 wherein the furniture is at least one of a cot, chair, and table.

8. The system of claim 1, wherein the fabric cover is at least one of a cot mattress, a chair seat, and a table top.

9. The system of claim 1, wherein the furniture is a rocking chair.

10. A compact furniture system, the system comprising:
a frame member, the frame member including:
a plurality of rod members; and
a connection mechanism for connecting one or more of the plurality of rod members to one another, the connection mechanism including each of an upper member and a lower member; and
a fabric cover;
wherein the connection mechanism includes each of a first rod member that extends into the connection mechanism, and a second rod member that extends through the connection mechanism;
wherein in a relaxed position, the first rod member and the second rod member are substantially parallel to one another; and
wherein in a rotated position, the upper member and the lower member are rotated relative to one another such that the first rod member and the second rod member are rotated relative to one another and are no longer substantially parallel to one another, and the fabric cover may be attached to the first rod member and the second rod member to retain the system in the rotated position; and
wherein the connection mechanism includes an internal plus shaped member which is engageable with one of the first rod member and the second rod member.

11. The system of claim 10, wherein at least one of the plurality of rod members includes two or more separate rod portions.

12. The system of claim 11, wherein the rod portions are connected by an elastic cord.

13. The system of claim 10, wherein the connection mechanism includes a plurality of cylindrical stoppers that abut the plus shaped member such that when the plus shaped member is rotated the cylindrical members compress.

14. The system of claim 13, wherein the cylindrical stoppers are made from a compressible material.

15. The system of claim 10, wherein the connection mechanism includes a plurality of receiver members that are sized and shaped to receive end portions of at least one of the plurality of rod members.

16. The system of claim 10 wherein the furniture is at least one of a cot, chair, and table.

17. The system of claim 10, wherein the fabric cover is at least one of a cot mattress, a chair seat, and a table top.

18. The system of claim 10, wherein the furniture is a rocking chair.

19. A compact furniture system, the system comprising:

a frame member, the frame member including:

a plurality of rod members configured to be in a stored position and an engaged position; and a connection mechanism for connecting one or more of the plurality of rod members to one another; and a fabric cover;

wherein the connection mechanism includes each of an upper member and a lower member such that an upper rod member may extend into the upper member of the connection mechanism, and a lower rod member may extend through the lower member of the connection mechanism;

wherein in a relaxed position, the upper rod member and the lower rod member are substantially parallel to one another;

wherein in a rotated position, the upper member and the lower member are rotated relative to one another such that the upper rod member and the lower rod member are rotated relative to one another and are no longer substantially parallel to one another, and the fabric cover may be attached to the upper rod member and the lower rod member to retain the system in the rotated position;

wherein in a stored position the plurality of rod members extend from one of the upper member and the lower member in manner substantially parallel to one another; and wherein in an engaged position the plurality of rod members extend radially outward from the connection mechanism.

* * * * *